US009321018B2

(12) United States Patent
Connors

(10) Patent No.: US 9,321,018 B2
(45) Date of Patent: Apr. 26, 2016

(54) GAS DIFFUSION APPARATUS FOR LIQUID AERATION AND CARBONATED LIQUIDS

(71) Applicant: Robert W. Connors, Lake Barrington, IL (US)

(72) Inventor: Robert W. Connors, Lake Barrington, IL (US)

(73) Assignee: Robert W. Connors, Lake Barrington, IL (US)

( * ) Notice: Subject to any disclaimer, the term of this patent is extended or adjusted under 35 U.S.C. 154(b) by 229 days.

(21) Appl. No.: 13/875,012

(22) Filed: May 1, 2013

(65) Prior Publication Data

US 2013/0292857 A1 Nov. 7, 2013

Related U.S. Application Data

(60) Provisional application No. 61/641,623, filed on May 2, 2012, provisional application No. 61/730,360, filed on Nov. 27, 2012, provisional application No. 61/740,881, filed on Dec. 21, 2012, provisional application No. 61/793,656, filed on Mar. 15, 2013, provisional application No. 61/811,484, filed on Apr. 12, 2013.

(51) Int. Cl.
*B01F 3/04* (2006.01)

(52) U.S. Cl.
CPC ..... *B01F 3/04241* (2013.01); *B01F 3/04262* (2013.01); *B01F 3/04801* (2013.01); *B01F 2215/0072* (2013.01)

(58) Field of Classification Search
CPC ..... B01F 3/04241
USPC ..... 261/30
See application file for complete search history.

(56) References Cited

U.S. PATENT DOCUMENTS 2,408,306 A 9/1946 Flournoy
4,115,500 A 9/1978 Voegeli (Continued)

FOREIGN PATENT DOCUMENTS

DE 29604406 10/1996
EP 2279786 2/2011

(Continued)

OTHER PUBLICATIONS

VineWineAccessoris.com, Wine-Stone Wine Aerator, http://www.vinewineaccessories.com/product/CCF-7728, Accessed Dec. 14, 2015.*

(Continued)

*Primary Examiner* — Duane Smith
*Assistant Examiner* — Adam W Bergfelder
(74) *Attorney, Agent, or Firm* — K&L Gates LLP

(57) ABSTRACT

A wine and spirit aerator includes a tube, a diffuser and an air pump attached to opposing ends of the tube. The aerator may include a stopper sized and shaped to be inserted into a lip of a wine or spirit bottle. The tube and diffuser can extend to the bottom of the bottle. The tube can have telescoping sections or be sized for single glass operation where the pump can be set on a structure between uses. The diffuser can be porous or sintered metal. The pump can be removed and replaced with a carbon dioxide injector to turn the aerator into a carbonated beverage preparation apparatus or a plant feeding apparatus. A method of marketing wine and spirits is also provided in which videos of same aerated by the disclosed aerators are posted to a website that offers both the aerators and the wine or spirit for purchase.

19 Claims, 16 Drawing Sheets

(56) References Cited

U.S. PATENT DOCUMENTS

| | | | | |
|---|---|---|---|---|
| 4,494,452 | A * | 1/1985 | Barzso | 99/323.1 |
| 4,610,282 | A * | 9/1986 | Brooks et al. | 141/46 |
| 5,595,104 | A * | 1/1997 | Delaplaine | 99/323.1 |
| 6,508,163 | B1 | 1/2003 | Weatherill | |
| 8,011,540 | B1 | 9/2011 | Peckels | |
| 8,413,858 | B2 | 4/2013 | Rasmussen et al. | |
| 8,430,023 | B2 | 4/2013 | Hynes | |
| 8,485,503 | B2 | 7/2013 | Lei | |
| 8,517,350 | B2 | 8/2013 | Tsai et al. | |
| 2002/0053577 | A1 | 5/2002 | Maas et al. | |
| 2005/0205609 | A1 | 9/2005 | Moore | |
| 2006/0032855 | A1 | 2/2006 | Hinkle | |
| 2006/0172041 | A1 | 8/2006 | Farrell | |
| 2006/0188617 | A1 | 8/2006 | Farrell et al. | |
| 2007/0187848 | A1 | 8/2007 | Sabadicci et al. | |
| 2007/0210109 | A1 | 9/2007 | Wiemholt | |
| 2007/0256568 | A1 | 11/2007 | Nudi et al. | |
| 2008/0219092 | A1 | 9/2008 | Clement | |
| 2008/0290102 | A1 | 11/2008 | Mangano | |
| 2009/0160072 | A1 | 6/2009 | Chiorazzi | |
| 2009/0181144 | A1 | 7/2009 | Farrell | |
| 2009/0212053 | A1 | 8/2009 | Lardino | |
| 2010/0006603 | A1 | 1/2010 | Weinberg et al. | |
| 2010/0011967 | A1 | 1/2010 | Barberio et al. | |
| 2010/0025867 | A1 | 2/2010 | Benton et al. | |
| 2010/0058933 | A1 | 3/2010 | Cheng | |
| 2010/0072637 | A1 | 3/2010 | Sabadicci et al. | |
| 2010/0090355 | A1 | 4/2010 | Weatherill | |
| 2010/0091605 | A1 | 4/2010 | Rasmussen et al. | |
| 2010/0122919 | A1 | 5/2010 | Burroughs et al. | |
| 2011/0024461 | A1 | 2/2011 | Kilduff et al. | |
| 2011/0024925 | A1 | 2/2011 | Mauffette | |
| 2011/0042835 | A1 | 2/2011 | Sabadicci et al. | |
| 2011/0127281 | A1 | 6/2011 | Mitchell | |
| 2011/0154994 | A1 | 6/2011 | Sabadicci | |
| 2011/0204093 | A1 | 8/2011 | Lee | |
| 2011/0268838 | A1 | 11/2011 | Vondrasek et al. | |
| 2011/0271846 | A1 | 11/2011 | Hynes | |
| 2011/0274805 | A1 | 11/2011 | Nudi, Jr. et al. | |
| 2011/0297001 | A1 | 12/2011 | DeJohn | |
| 2011/0297006 | A1 | 12/2011 | Belcher | |
| 2012/0012718 | A1 | 1/2012 | Tiso | |
| 2012/0074092 | A1 | 3/2012 | Devoy et al. | |
| 2012/0074172 | A1 | 3/2012 | Federighi | |
| 2012/0111153 | A1 | 5/2012 | Ward | |
| 2012/0111893 | A1 | 5/2012 | Luebke | |
| 2012/0156338 | A1 | 6/2012 | Agarwal et al. | |
| 2012/0156345 | A1 | 6/2012 | Agarwal et al. | |
| 2012/0164290 | A1 | 6/2012 | Gerrits | |
| 2012/0164300 | A1 | 6/2012 | Niazi | |
| 2012/0167775 | A1 | 7/2012 | Burroughs et al. | |
| 2012/0199013 | A1 | 8/2012 | Gutierrez | |
| 2012/0201942 | A1 | 8/2012 | Kilduff et al. | |
| 2012/0261844 | A1 | 10/2012 | Lei | |
| 2012/0269945 | A1 | 10/2012 | Wijnen et al. | |
| 2012/0272831 | A1 | 11/2012 | Barberio et al. | |
| 2012/0280410 | A1 | 11/2012 | Hardison | |
| 2013/0099398 | A1 | 4/2013 | Takase et al. | |
| 2013/0122161 | A1 | 5/2013 | Cole et al. | |
| 2013/0140721 | A1 | 6/2013 | Borden et al. | |
| 2013/0153685 | A1 | 6/2013 | Drobot et al. | |
| 2013/0202757 | A1 | 8/2013 | Hawkins | |
| 2013/0207284 | A1 | 8/2013 | Heyman et al. | |

FOREIGN PATENT DOCUMENTS

| | | |
|---|---|---|
| GB | 712325 | 7/1954 |
| WO | 0018499 | 4/2000 |

OTHER PUBLICATIONS

Prodyne, Wine Wand™ Automatic Wine Aerator, http://www.prodyne.com/index.php/catalog/item/24-corkscrews-wine-openers-wine-accessory-sets/11-ww-4, Accessed Dec. 14, 2015.*

International Search Report for PCT Application PCT/US2013/039109 mailed May 1, 2013. 6 pages.

Wine Wand—Wine Aerator.

Wine Stone—Wine Aerator.

* cited by examiner 280
284
272
274
282
276
278
270

280
284
272
282
276
270

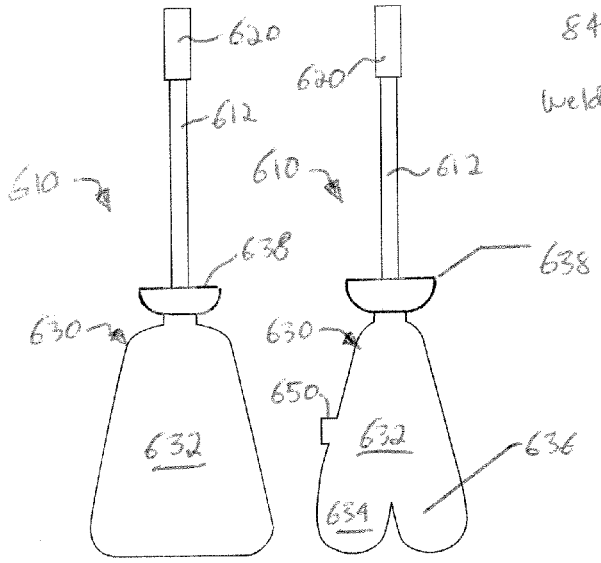
Fig. 17A
Fig 17B
Fig. 19B
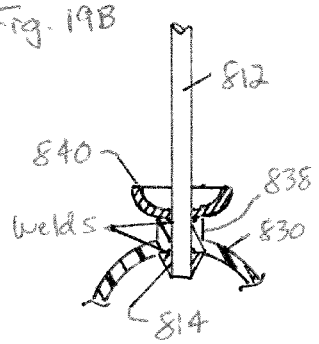
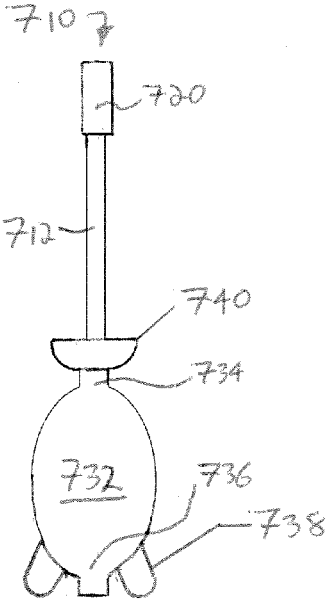
Fig. 18
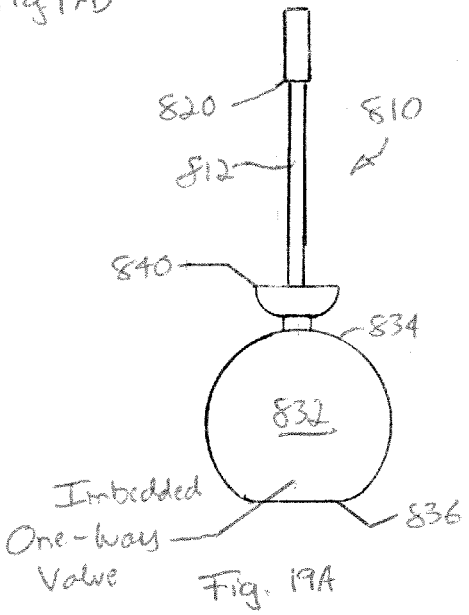
Fig. 19A

GAS DIFFUSION APPARATUS FOR LIQUID AERATION AND CARBONATED LIQUIDS

PRIORITY CLAIM

This application claims priority to and the benefit of: (i) U.S. Provisional Patent Application No. 61/641,623, entitled, "Wine Aerator", filed May 2, 2012; (ii) U.S. Provisional Patent Application No. 61/730,360, entitled, "Gas Diffusion Apparatus For Wine Aeration And Carbonated Beverage Preparation", filed Nov. 27, 2012; (iii) U.S. Provisional Patent Application No. 61/740,881, entitled, "Gas Diffusion Apparatus For Wine Aeration And Carbonated Beverage Preparation", filed Dec. 21, 2012; (iv) U.S. Provisional Patent Application No. 61/793,656, entitled, "Gas Diffusion Apparatus For Wine Aeration And Carbonated Beverage Preparation", filed Mar. 15, 2013; and (v) U.S. Provisional Patent Application No. 61/811,484, entitled, "Gas Diffusion Apparatus For Wine Aeration And Carbonated Beverage Preparation", filed Apr. 12, 2013, the entire contents of each of which are incorporated herein by reference and relied upon.

BACKGROUND

The present disclosure relates generally to gas in liquid diffusion, and in particular to the delivery of good tasting wine and spirits and the online preparation of carbonated liquids.

Whether the bottle of wine is expensive or not, people want their wine to taste good. It is known to aerate wine, or to let it breathe, before drinking the wine. And it is generally understood that just about any wine will benefit from proper aeration. One problem with attempting to let wine, especially red wine, breathe is that the process takes time. In a social setting, for example at a home party or celebration, wine bottles may be opened at a pace that is not conducive to letting bottles sit open for extended amounts of time. In a restaurant setting, a similar problem can occur when there may simply be too many different bottles to be opened to maintain a primary set of bottles for pouring and a secondary set of bottles that are breathing, or being readied for pouring. The result is that more often than not, wine is not properly aerated before it is consumed. And too, spirits such as scotch are not properly aerated before consumption.

Carbonated beverages are also known. Carbonated beverages can contain ingredients that are not considered to be healthy. Carbonated beverages also produce a large amount of metal and plastic waste.

Improved apparatuses and methods for aerating wine and spirits for preparing carbonated liquids are needed accordingly.

SUMMARY

The present disclosure in one primary aspect provides devices or apparatuses for aerating wine, that is, letting wine breathe before it is consumed. The apparatuses are portable, light weight, cost effective and may prevent spills if the wine bottle should tip inadvertently. The devices can aerate an entire bottle of wine in a very short period of time, for example, on the order of seconds. The devices can alternatively aerate a single glass of wine. The devices can aerate both red and white wine very effectively. In one embodiment, the device is spatially adjustable within the bottle so that the user can aerate only a glass or two's worth of wine, so that the rest of the wine can be recapped or recorked for later consumption. Further, the devices are not limited to the effective aeration of wine but can also effectively aerate any liquid containing tannins, such as liquids aged in a wood or oak barrel. For example, spirits such as bourbon, brandy, cognac, gin, liqueur, rum, scotch, tequila, whiskey and other liquids aged in wooden or oak barrels and are easily and effectively aerated by the devices of the present disclosure.

Thus it is expressly contemplated that in a new aeration methodology of the present disclosure, an aerator is structured so that it can be used to aerate a spirit, operated in a cleaning liquid to remove residual spirit from the aerator, and then used to aerate wine, and vice-versa, over and over again. That is, the air can be pumped to a bottle or glass of wine, the aerator can then be inserted into a glass of water or carbonated water and operated to clean the wine from the aerator, after which the aerator can be used immediately with the same or different wine, or with another type of beverage.

In one embodiment, the aerating apparatus includes a tube, such as a metal, plastic or rubber tube that is inserted into the wine bottle for the delivery of air to the wine. The tube can for example be a 0.250 inch (about 6 millimeter ("mm")) outside diameter tube stainless steel tube, such as type 304 or 316 stainless steel. The tube can have a length for example of about ten to eighteen inches (about 25 to 46 centimeters ("cm"). It should be noted that the dimensions listed herein serve as a working examples and are not intended to limit the present disclosure to the given dimension(s)).

The tube can have telescoping sections, such as two or three telescoping sections. The telescoping sections include at least one larger outer diameter section and at least one smaller outer diameter section. The smaller outer diameter section slides or telescopes within the larger outer diameter section, so as to be settable at any length within a minimum overall length and a maximum overall length. The telescoping sections each include a collar, the larger outer diameter section having a collar located on its inner surface, and the smaller outer diameter section including as collar located on its outer surface. The collars, e.g., nylon collars, serve as seals and promote smooth sliding between the telescoping sections. As illustrated below, the collars also keep the movement between the telescoping sections concentric, so that the sections do no cock against one another. With a two section telescoping aerator, when the collars are pushed apart as far as possible, the telescoping aerator is at a minimum overall length. When the collars are abutted together, the telescoping aerator is at a maximum overall length. With a three section telescoping aerator, when for example two outer tubes meet each other over an inner tube, the three section telescoping aerator is in its most contracted condition. When the two outer tubes are pulled away from each other to the ends of the smaller diameter inner tube, the alternative three section telescoping aerator is in its most expanded condition.

The distal end of the tube (the end inserted into the wine) includes or is attached to an air diffuser. The air diffuser is in one embodiment a perforated, sintered or porous structure that receives air from the distal end of the tube and disperses the air in multiple directions, e.g., in a plume-line manner, into the wine. In one embodiment, the diffuser is a metal or stainless steel (e.g., type 304 or 316 stainless steel) porous or sintered metal cup, whose pores or openings can be less than one-hundred microns in average diameter, e.g., ten, five, two, or less than one micron. The metal diffuser can be threaded for threaded engagement with a distal end of the insertion tube. In another embodiment, the diffuser is an airstone used typically with fish tanks to introduce or infuse air into the tank water. The material for the airstone diffuser can be a lightweight wood, plastic, composite or cork material. In a further alternative embodiment, the material for the diffuser is a porous plastic, e.g., a food grade plastic.

Any of the diffuser materials can be continuous and formed with the perforations or pores or be made of multiple plies to have the perforations or pores. The perforations or pores are also small enough in one embodiment, such that the forcing of air through the diffuser causes the air bubbles entering the wine to be very small, e.g., to be microbubbles. The small bubbles diffuse much more easily and effectively into the wine. The perforations or pores can also be small enough such that wine or liquid does not enter the diffuser when the tube and diffuser are placed into the wine or liquid. The hydrophobic nature of the diffuser allows air to be located within the diffuser and tube at the time of pump actuation, which helps to deliver air smoothly into the wine.

A cork or stopper may be attached to or formed with the tube and is oriented, such that the stopper can be sealingly and releaseably inserted into the upper lip of the bottle to position the distal end of the air tube and diffuser at a desired elevational location within the bottle. The stopper can have a standard wine bottle cork shape and be made of cork or be made of another material, such as rubber or plastic. The stopper can be formed with, e.g., molded with, the tube. The stopper can include a hole through which the tube is inserted, e.g., press-fittingly inserted. The tube is inserted through the hole at a distance along the tube that sets the diffuser at a desired location within the bottle when the cork is sealed to the lip of the bottle.

In one embodiment, the stopper is permanently attached, e.g., mechanically and/or adhesively attached, to the tube at a position on the tube that places the distal end of the tube towards the bottom end of the bottle when the stopper is inserted into the lip of the bottle. In such position, air dispersed from the distal end of the tube and diffuser is diffused into the wine at the bottom of the bottle. As air is introduced into the wine, the lighter air is forced upwards, such that the air is diffused throughout the entire bottle of wine. Again, the stopper can alternatively be formed with the tube.

In another embodiment, the stopper is moveably attached, e.g., moveably press-fitted, to the tube, such that the cork can be slid to different positions along the tube and held releaseably at each of the positions. The positions are set so that the user can select to aerate the entire bottle of wine at once or to alternatively aerate only one or more glass of wine. Thus one of the positions is the permanently attached full bottle aeration position discussed above. A second position can be about halfway between the first position and the distal end of the tube. The second position aerates half the wine bottle. Assuming an average bottle of wine to contain four glasses, the second position would then aerate about two glasses of wine. A third position would be located approximately between the second position and the diffuser and would aerate a single glass of wine within the bottle. Each position, e.g., the three positions, can be marked by a non-dissolvable coloration or physical mark. Alternatively or additionally, each of the positions can be designated by a protrusion or pair of protrusions, such as radial protrusions extending around the tubing, which help to hold the cork in a desired one of the positions. For example, the protrusions can create a slight snap-fitting location for the cork at each of the positions.

It is contemplated not to provide a stopper in various embodiments. This allows air injected via the aerator to flow through the wine or spirit and out of the bottle.

An air pump is provided at the proximal end of the tube, opposite the diffuser. The pump can be an electric air pump that runs off of house electrical or alternating current power. The electric pump can alternatively run off of direct current battery power, e.g., via rechargeable and/or replaceable batteries. In one preferred embodiment, however, the pump is a handheld air pump. The handheld air pump is in one embodiment a squeezable rubber or plastic bulb that allows the user to manually introduce a volume of air into the tube, through the diffuser, and into the wine with each squeeze. The handheld air pump can be a known type that is used for example for blood pressure cuffs, to blast air to clean camera lenses, or as a portable sports ball pump. The pump can be plastic or rubber, such as latex polyvinyl, chloride ("PVC") or silicone, and include a threaded insert (e.g., metal or plastic) that threads onto the proximal end of the tube.

The pump has an outlet that connects directly to the proximal end of the tube, e.g., via a threaded, compression or shrink wrap connection. An o-ring seal and/or a sealing adhesive may be used additionally to connect the pump outlet to the tube. Alternatively, the outlet of the pump can be fitted to a needle that pierces a pierceable seal fitted into the proximal end of the tube. The seal can be a pierceable, e.g., silicone, plug or be a slitted or otherwise pierceable septum. The pump can also include a threaded plug or insert as illustrated below for stiffening the pump and/or for sealing threads to the pump.

The hand operated pump is lightweight and inexpensive. The light weight helps to prevent the bottle from tipping when the aeration device is inserted into the bottle. Also, if the bottle should tip by accident, the stopper if provided will prevent any wine from spilling out of the bottle. The diffuser is also impermeable to water in one embodiment, such that wine cannot back up into the tube or the pump should the bottle be spilled by accident. Also as a result of the diffuser being generally impermeable to liquid or wine, when a negative pressure is applied by the pump, e.g., via an electric motor or expanding bulb pumping action, the pump pulls in air from ambient as opposed to sucking wine into the tube via the diffuser.

The present disclosure also sets forth multiple embodiments for a single glass aerator using the pump, tube and diffuser of using the full bottle aerator. The bulb pump is structured in various ways to be set on a table or other structures between uses and to support the tube and diffuser vertically above the bulb pump.

A method using any of the aerators of the present disclosure to promote the sale of wine is also disclosed. Aerator sales are used to promote a website or marketplace at which the wine or spirits may be sold. The website or marketplace hosts videos of different wines or spirits being aerated by any of the aerators of the present disclosure. Features and aspects of each of the wines or spirits are discussed in the video in the context of how the aerator brings out and enhances the flavor of the wines. The video is accompanied by a shopping cart or similar mechanism on the website or marketplace that allows each of the wines, discussed and analyzed after being aerated by one of the aerators of the present disclosure, to be selected for purchase. The sale of wine or spirits may be accompanied with the sale of one of the aerators discussed herein.

The present disclosure in another primary aspect also provides a carbonated beverage preparation apparatus. In an embodiment, the aerator's bulb pump threads onto the tube. The aerator's bulb pump can accordingly be removed from the tube. The bulb is replaced by a carbon dioxide ("$CO_2$") injector, which can be attached directly to (e.g., threaded to) the tube or be attached to the injector tube via a secondary tube, such as a flexible plastic tube. The carbonated beverage preparation apparatus can be provided as a standalone apparatus and does not have to be a changeover device from the aerator. For example, the injector tube of the beverage preparation apparatus can be shorter than for the wine aerator.

The $CO_2$ injector is in one embodiment, connected to and carried with the injector tube. A cap, such as a threaded and/or gasketed cap, is slid sealingly over the injector tube before the $CO_2$ injector is connected to the injector tube. The cap threads onto or otherwise seals to a bottle or container. The container carries a liquid, such as water, and mixing ingredients, such as fruit and/or juice concentrate. When the $CO_2$ injector is actuated, $CO_2$ gas is flowed from the injector, through the tube and diffuser, into the liquid and whatever mixing consumables are present in the liquid. The $CO_2$ gas carbonates the liquid and helps to disperse and mix flavors from the mixing consumables into and with the liquid in the bottle or container. It is believed that the diffuser will smooth the delivery of $CO_2$ gas into the liquid enough so that the bottle or container does not have to be capped or sealed and can instead be an open container, such as a glass.

The $CO_2$ injector can have a pressure or flow reducer placed upstream of the diffuser to lower the pressure or flow of $CO_2$ reaching the diffuser. It is contemplated to use the injector additionally to feed land-based (e.g., cut flowers in water) and aquatic plant life.

In light of the present disclosure, it is accordingly an advantage of the present disclosure to provide a wine or spirits aerator or breathing apparatus that is effective to aerate an entire bottle of wine or spirits in a short period of time.

It is another advantage of the present disclosure to provide a wine or spirits aerator or breathing apparatus that is cost effective.

It is a further advantage of the present disclosure to provide a wine or spirits aerator or breathing apparatus that is lightweight.

It is yet another advantage of the present disclosure to provide a wine or spirits aerator or breathing apparatus that is in one implementation adjustable so that the user can selectively aerate an entire bottle of wine or some quantity less than an entire bottle, such as half a bottle or one glass.

It is yet a further advantage of the present disclosure to provide a wine or spirits aerator or breathing apparatus that is in one implementation manually powered such that the apparatus is highly portable and does not require power.

It is still another advantage of the present disclosure to provide a wine aerator or spirits or breathing apparatus that is telescopically expandable and contractible to a desired length for use and for convenient transport.

It is moreover and advantage of the present disclosure to provide an aerator that can aerate red, white wines or any spirit aged in a barrel.

Moreover, it is an advantage of the present disclosure to provide an aerator that can aerate glasses or bottles of both wines and spirits.

Still further, it is an advantage of the present disclosure to provide a single glass aerator that can be set quickly on a table between uses and support the liquid contacting portion of the aerator such that it does not contact the table.

It is still a further advantage of the present disclosure to provide a wine distribution marketing method that uses sales of the aerators as a way to promote a website or marketplace that shows wines for purchase being aerated by the aerators of the present disclosure.

Yet another advantage of the present disclosure is to provide a carbonated beverage preparation apparatus, which allows carbonated beverages to be prepared instantaneously, as needed.

Yet a further advantage of the present disclosure is to provide a carbonated beverage preparation apparatus that is adaptable from a wine aeration apparatus and vice-versa.

Further still, an advantage of the present disclosure is to provide a carbonated liquid apparatus for feeding land-based or aquatic plants.

Additional features and advantages are described herein, and will be apparent from, the following Detailed Description and the figures.

BRIEF DESCRIPTION OF THE FIGURES

FIGS. 17A and 17B are front and side elevation views, respectively, of another embodiment for a standalone, glass-by-glass version of a wine or spirits aerator or breathing apparatus of the present disclosure.

FIG. 18 is a side elevation view of a further embodiment for a standalone, glass-by-glass version of a wine or spirits aerator or breathing apparatus of the present disclosure.

FIG. 19A is a side elevation view of a yet another embodiment of a standalone, glass-by-glass wine or spirits aerator of the present disclosure.

FIG. 19B is a partially sectioned elevation view illustrating one drip cup and stem and bulb connection apparatus and method for any single glass wine or spirits aerator discussed herein.

DETAILED DESCRIPTION

Fixed Length Aerators

Figure 1:
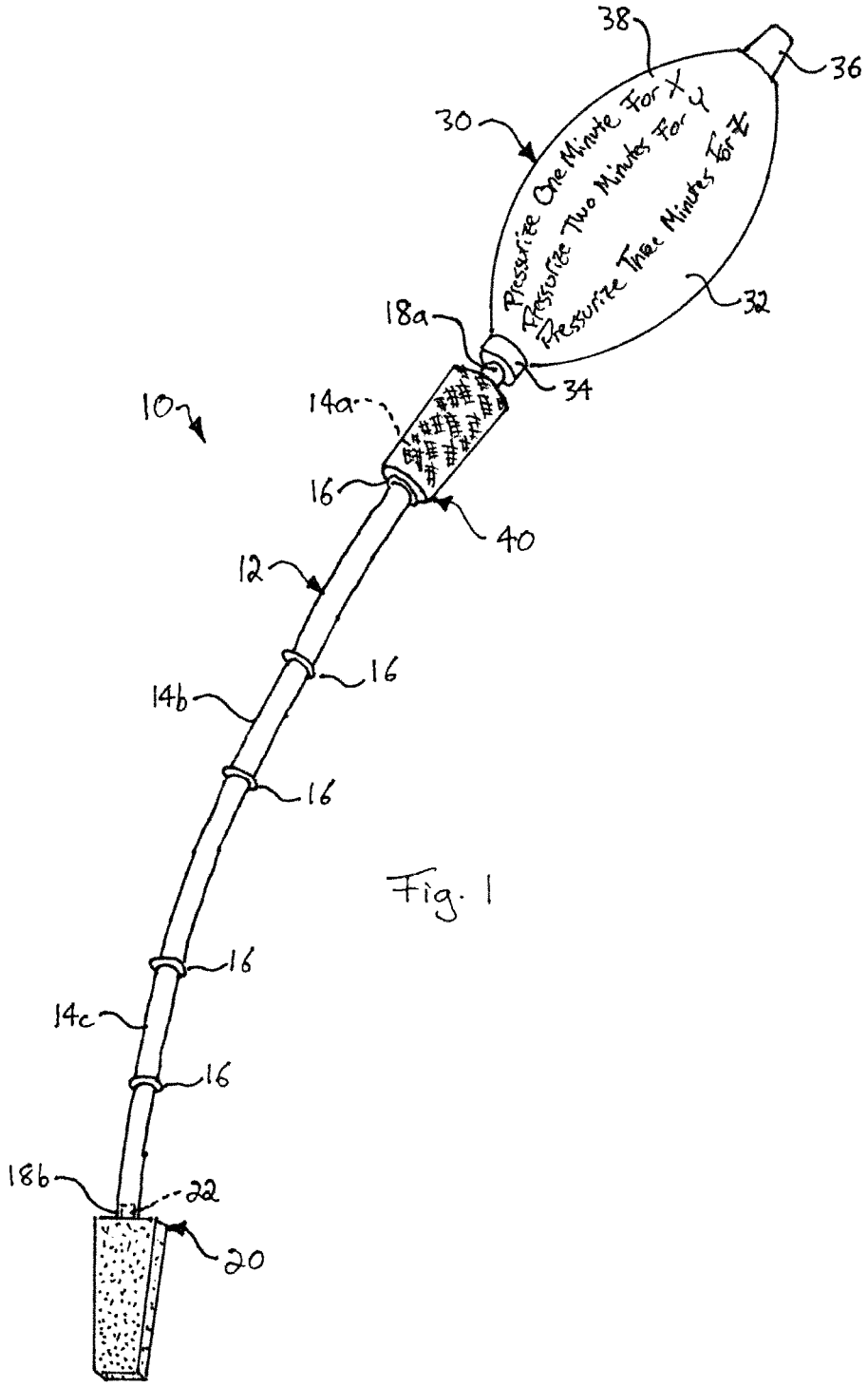
FIG. 1 is a perspective view illustrating one primary embodiment for a wine aerator or breathing apparatus of the present disclosure.

Referring now to the drawings and in particular to FIG. 1, various implementations of one primary embodiment for a wine or spirits aerator or breathing apparatus of the present disclosure are illustrated by aerator 10. The primary components of aerator 10 include a tube or straw 12, a diffuser 20, a hand or bulb air pump 30 and a stopper or cork 40. Tube or straw 12 can be made of a plastic, rubber or metal material. To reduce cost, or to make a lower cost version, it may be desirable to make tube 12 out of plastic or rubber. Suitable plastics for tubing 12 include polyvinyl chloride ("PVC"), high density polyvinyl chloride ("HDPVC"), low density polyvinyl chloride ("LDPVC"), ultra-high density polyvinyl chloride ("UHDPVC"), polyethylene, polypropylene, nylon, polyester and polystyrene. Plastic tubing 12 can be clear, semi-clear, or white, for example. Plastic may be desirable for its ability to bend but also to generally hold its shape while inserted into the wine bottle. Suitable rubbers for tubing 12 include buna-N, butyl, neoprene, silicone, vinyl and viton. Rubber may be preferred if it is desired that tube 12 be able to bend down along the wine bottle when not fully inserted into the bottle. If metal, tube 12 can be made of a non-oxidizing metal, such as stainless steel, e.g., type 304 or 316 stainless steel.

Tube 12 includes one or more zones 14*a*, 14*b*, 14*c*, etc., for receiving stopper 40. In an embodiment, only a single zone is provided, e.g., zone 14*a*, and stopper is fixed at that zone. In another embodiment, no discernable zones are provided and tube 12 can be sealingly slid within stopper 40 to a desired position. In this manner, there are many, many zones for receiving stopper 40 along tube 12, and the user can feed tube 12 through stopper 40 until diffuser 20 hits the bottom of the wine bottle, for example, to ensure that the entire bottle of wine is quickly aerated.

In the illustrated embodiment of FIG. 1, there are three dedicated zone settings 14*a*, 14*b* and 14*c*. Again, there may be more or less than three zone settings. As illustrated, zone setting 14*a* allows tube 12 and diffuser 20 to extend furthest into the wine bottle, e.g., so that the entire bottle of wine is quickly aerated. Zone setting 14*b* allows tube 12 and diffuser 20 to extend roughly halfway into the wine bottle, e.g., so that approximately half of the bottle of wine is quickly aerated. Zone setting 14*c* allows tube 12 to extend a shorter distance into the wine bottle, e.g., so that a single glass of wine is quickly aerated.

In the illustrated embodiment, the entire zone 14*a*, 14*b* or 14*c* is marked, so that the user moves tube 12 within cork or stopper 40 until the marked zone is completely out of view or hidden, at which time the user knows that the tube is set properly at the particular zone. In alternative embodiments, the user moves tube 12 within stopper 40 until a zone marker on the tube meets with the top or bottom of stopper 40. In any case, any marker can be a coloration and/or texture added to tube 12. The coloration, e.g., printed, painted, powder-coated or applied via a colored insert, can be applied to the inside or outside of tube 12. Applying the coloration to the inside of tube 12, e.g., a clear, semi-clear or white tube, prevents any contact between the wine and the coloration, which may be desirable to consumers.

In the illustrated embodiment, circular or semi-circular stopper holding members or ribs 16 are placed on the proximal (towards pump 30) and distal (towards diffuser 20) ends of each zone setting 14*a*, 14*b* and 14*c*. Ribs 16 help the user to know when tube 12 is placed properly so that stopper 40 resides at one of the receiving zones. Ribs 16 also help hold tube 12 fixed at the selected zone 14*a*, 14*b* or 14*c* relative to stopper 40. While two ribs 16 are illustrated for each zone 14*a*, 14*b* and 14*c* in FIG. 1, a single rib 16, e.g., a distal rib, could be provided for each zone instead. The single rib 16 still provides tactile feedback to the user, and if a distal rib, still helps to hold tube 12 fixed at a selected one of zones 14*a*, 14*b* or 14*c*.

As illustrated in FIG. 1, tube 12 includes a proximal end 18*a* and a distal end 18*b*. Hand or bulb air pump 30 is connected to or fixed to the proximal end 18*a*, while diffuser 20 is connected to or fixed to the distal end 18*b* of tube 12. In various embodiments, air pump 30 is press-fitted into, press-fitted onto, threaded onto, threaded into, compression fitted to, shrink-wrap fitted to, and/or adhered to proximal end 18*a* of tube 12. Diffuser 20 can likewise be removeably press-fitted into, press-fitted onto, threaded onto, threaded into, compression fitted to, adhered to, and/or formed integrally with or permanently attached to distal end 18*b* of tube 12.

Diffuser 20 in one embodiment is made of a sintered, porous or perforated material. Diffuser 20 can be layered to have or formed to have small diffusing holes, openings or apertures. Diffuser 20 can alternatively be of a polymer material, wood, cork, rubber, metal or combinations thereof. Diffuser 20 can be plastic and be formed with, e.g., injection molded with, tube 12. Diffuser 20 can be an airstone. The airstone can be one used to deliver air into water, typically used for fish tanks Diffuser 20 causes the air delivered through tube 12 to the diffuser to be separated into small bubbles, such as microbubbles, when delivered to the wine.

The small bubbles help the air to mix with and diffuse into the wine as opposed to simply migrating to the top of the bottle, without mixing.

In one embodiment, diffuser 20 is a stainless steel (e.g., type 304 or 316 stainless steel) porous cup or porous capped tube segment. The pore size can, for example, be less than one-hundred microns, such as ten microns, five microns, two microns, one micron or less than one micron, such as a half-micron or fraction of a micron. Smaller pore sizes make smaller air bubbles, which helps the air to diffuse into the wine. Diffuser 20 is in one embodiment generally impermeable to liquids. If diffuser 20 is left within a full bottle of wine for an extended period of time, the diffuser may eventually allow wine to seep through its walls. However, diffuser 20 is generally hydrophobic and will not allow wine or liquids to enter quickly. Air will thus be present in diffuser 20 and tube 12 when pump 30 is actuated, which is believed to further smoothen air introduced into the wine or liquid.

The pump can be an electric, e.g., AC or DC line or battery powered air pump, such as an air pump used with fish tanks. The pump is in one preferred embodiment a hand or air pump 30 as illustrated in FIG. 1. Hand or air pump 30 is in one embodiment made of rubber or plastic, such as latex, silicone or polyvinylchloride ("PVC"). Air pump 30 has a mechanically or hand squeezable portion 32. Squeezable portion 32 in the illustrated embodiment has a bulb shape. The bulb shape can be rounder, like a tennis ball or flatter, like an American football or rugby ball. Squeezable portion 32 can still further alternatively be egg-shaped, where the narrow end of the egg resides at attachment end 34, or where the narrow end of the egg resides at air intake end 36. Squeezable portion 32 terminates at an attachment end 34 and an air intake end 36. Attachment end 34 of air pump 30 (i) can include threads (male or female, e.g., via a threaded insert screwed or press-fitted and/or adhered into attachment end 34) for connecting to mating threads of proximal end 18*a* of tube 12, (ii) be sized to press-fit onto or into (e.g., via barbs) proximal end 18*a* of tube 12, (iii) include a compression fitting (e.g., ferrule and nut) for compressing onto tube 12, (iv) be sized and shaped to be adhered to the outside or inside of proximal end 18*a* of tube 12, and/or (v) include a check valve that in turn connects to proximal end 18*a* of tube 12 via any of the attachment mechanisms listed in (i) to (iv).

In a further alternative embodiment, proximal end 18*a* of tube 12 is connected in a seal-tight manner to attachment end 34 of pump 30 via a shrink-wrap fitting. Here, proximal end 18*a* of tube 12 can abut against attachment end 34 of pump 30, wherein the shrink-wrap fitting is heated and shrunken in a seal-tight manner about the abutted interface between the ends. Alternatively, one of the ends 18*a* or 34 is a male end that fits into the other of the ends 18*a* or 34, which is a female end. The shrink-wrap fitting is again heated and thus shrunken in a seal-tight manner about the male/female interface between the ends. In an embodiment, the shrink-wrap fitting eliminates the need for threads or compression connectors.

Air intake end 36 of air pump 30 includes a hole, valve or septum that opens when squeezable portion 32 is squeezed closed to allow air to enter bulb air pump 30. That hole, valve or septum closes when the bulb air pump is full of air or when portion 32 is squeezed, so that when squeezable portion 32 is squeezed closed, air is forced out attachment end 34 of pump 30, through tube 12 and diffuser 20, into the wine held within the wine bottle. In an embodiment, air intake end 36 of air pump 30 includes a check valve that allows air to inflate squeezable portion after being squeezed closed but prevents air from leaving air intake end 36 while squeezable portion 32 is being squeezed. The small pores of diffuser 20 also make it much easier for air to enter intake end 36 of pump 30 as opposed to diffuser 20, eliminating the need for a check valve at attachment end 34 of pump 30.

In the illustrated embodiment of FIG. 1, squeezable portion 32 is provided with indicia or writing that helps to explain how to operate aerator 10. It is believed that the amount of air that is pumped into the wine bottle and the time that the air is held corked within the wine bottle could affect the amount or thoroughness of the aeration or breathing of the wine. In the illustrated example, indicia 38 indicates that the wine should be kept under air pressure or capped for a first time, e.g., one minute, for a first type of wine, e.g., rosé. Indicia 38 indicates that the wine should be kept under air pressure or capped for a second time, e.g., two minutes, for a second type of wine, e.g., merlot. Indicia 38 further indicates that the wine should be kept under air pressure or capped for a third time, e.g., three minutes, for a third type of wine, e.g., cabernet. Through experimentation, however, it has been found that even without stopper 40, aeration according to the present disclosure occurs very quickly, on the order of seconds. Indeed, removing stopper 40 enables the air to flow through the aerated liquid and out the bottle or glass.

Indicia 38 can include other instructions or information, such as how many squeezes of air pump 30 to make for a particular type of wine. Indicia 38 can alternatively or additionally include information for properly aerating a single glass of wine, versus a half bottle of wine, versus a full bottle of wine for example. Indicia 38 can alternatively include washing instructions and/or logo or brand information, such as the listing of a corresponding website or marketplace. In one embodiment, aerator 10 can be washed in a standard dishwasher or sink. Still further alternatively, indicia 38 can include advertising or logo information for a company, event or other entity that purchases multiple aerators 10 for distribution as gifts, favors, or as part of a package.

Stopper 40 can be made of cork, plastic, rubber and combinations thereof. Stopper 40 includes a hole or bore 42 (FIGS. 5, 6A and 6B) that fits over tube 12. The inner wall of bore 42 can be adhered to the outside surface of tube 12 or be slideably fitted to the outside surface of tube 12. As discussed above, stopper 40 can alternatively or additionally be held to tube 12 via one or more circular rib 16 surrounding or partially surrounding the outside of tube 12. As discussed above, tube 12 is in a further alternative embodiment permanently fixed to stopper 40 at the full aeration zone 14*a* of FIG. 2. Stopper 40 can be formed with tube 12 at such position or be adhesively adhered and/or mechanically affixed to tube 12 at the full bottle aeration location. It is believed that injecting air bubbles at the bottom of bottle 50 enables the weight of the wine to compress the bubbles and cause them to break into smaller bubbles, e.g., microbubbles, which are better adept at diffusing into the wine as the bubbles rise to the surface of bottle 50.

Stopper 40 can be tapered as illustrated to be releaseably inserted into an upper lip of the wine bottle so that the wine bottle is sealed by the stopper. Stopper 40 and aerator 10 can be removed readily from the wine bottle upon completion of the aeration so that the wine can then be consumed. Aerator 10 can then be inserted into a second wine bottle, and so on.

In one embodiment, attachment end 34 of pump 30 resides at, e.g., touches, the upper or proximal end of stopper 40 when the stopper is fixed to or moveably placed at full bottle aeration zone 14*a*. Or, the attachment end 34 of pump 30 can be directly adjacent to the upper or proximal end of stopper 40 when the stopper is fixed to or moveably placed at full bottle aeration zone 14*a*. Doing so limits the moment arm between stopper 40 and pump 30, reducing the ability of the pump to topple the wine bottle. If the bottle does topple, stopper 40 should prevent wine from spilling out of the wine bottle, and diffuser 20 should prevent wine from entering tube 12 or pump 30.

Figure 4:
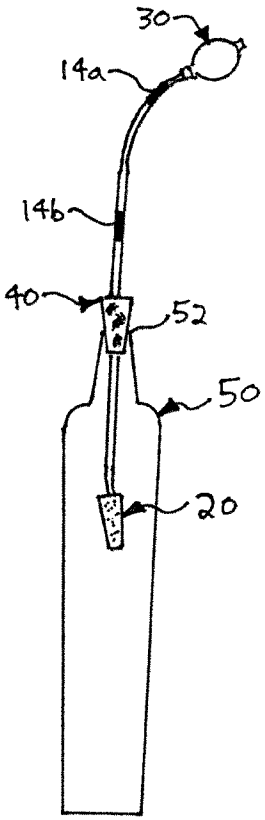
FIG. 4 is an elevation view of one embodiment of a wine aerator or breathing apparatus of the present disclosure inserted into a wine bottle so as to aerate roughly a glass of wine.
Figure 3:
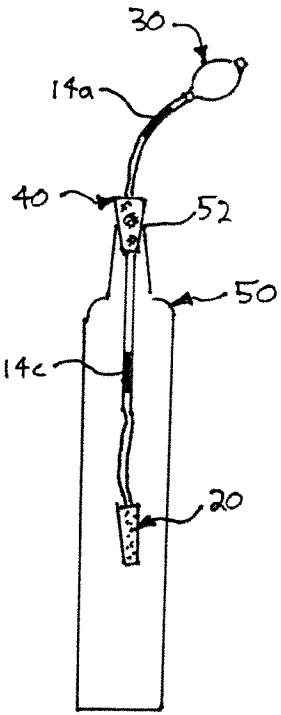
FIG. 3 is an elevation view of one embodiment of a wine aerator or breathing apparatus of the present disclosure inserted into a wine bottle so as to aerate roughly half of the bottle of wine.
Figure 2:
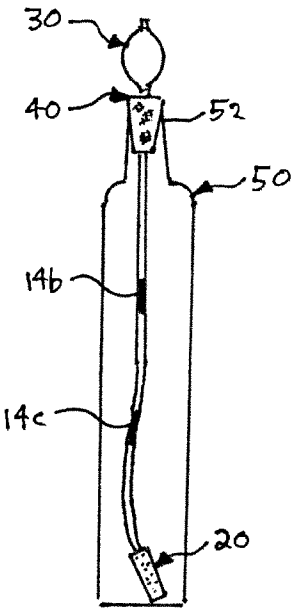
FIG. 2 is an elevation view of one embodiment of a wine aerator or breathing apparatus of the present disclosure inserted into a wine bottle so as to aerate the entire bottle of wine.

Referring now to FIGS. 2, 3 and 4, aerator 10 is illustrated positioned at a full bottle aeration location (FIG. 2, zone 14*a*) relative to wine bottle 50, a half bottle aeration location (FIG. 3, zone 14*b*) relative to wine bottle 50, and a single glass aeration location (FIG. 4, zone 14*c*) relative to wine bottle 50. Zones 14*b* and 14*c* could alternatively correspond to different aeration amounts than those discussed herein, e.g., alternatively two-thirds aerated (zone 14*b*) and one-third aerated (zone 14*c*). In each of FIGS. 2 to 4, stopper 40 is releaseably but securely and sealingly fitted into the lip or neck 52 at the top of wine bottle 50.

Air bubbles diffuse into the wine on a rising basis when aerator 10 is set at intermediate aeration zone 14*b* or minimum aeration zone 14*c* relative to stopper 40 and bottle 50. Thus, if the wine is poured quickly after aerator 10 is set and used at intermediate aeration zone 14*b* or minimum aeration zone 14*c*, most of the air introduced by pump 30 may be poured out of bottle 50 when the desired number of wine glasses are poured. If the wine bottle is recorked quickly after pouring, the remaining wine should remain in the bottle relatively non-aerated.

It should be appreciated that in FIGS. 2 to 4, an in any embodiment described herein, stopper 40 is not needed and aerator 10 can instead be held by the user at the full bottle aeration location (FIG. 2, zone 14*a*) relative to wine bottle 50, the half bottle aeration location (FIG. 3, zone 14*b*) relative to wine bottle 50 or the single glass aeration location (FIG. 4, zone 14*c*) relative to wine bottle 50. It is also expressly contemplated for any embodiment described herein to first pour a glass or glasses of wine and then to place aerator 10 (or any of other aerator 110 or 210 discussed below) into the glass or glasses of wine to aerate the freshly poured wine. In this manner, if the user does not wish to drink the entire bottle of wine, the user can pour one or more glasses of wine for aeration and then re-cork the wine remaining in the bottle.

Figure 5:
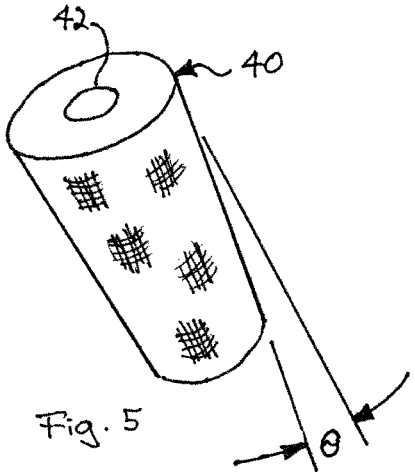
FIG. 5 is a top perspective view of one embodiment for a stopper or cork useable with any wine aerator or breathing apparatus described herein.

Referring now to FIG. 5, one embodiment for stopper or cork 40 is illustrated. Stopper 40 can be made of any of the materials discussed above, including any of the plastics or rubbers discussed above. In the illustrated embodiment, stopper 40 includes a bore or aperture 42 formed with or machined into stopper 40. Aperture 42 can have a diameter that is the same as, slightly smaller than, or slightly larger than an outside diameter of tube 12 (e.g., 0.250 inch or 6.4 mm outside diameter tubing), so that stopper 40 can be readily slideably affixed to, adhered to and/or mechanically attached to the outside of tube 12. It should be again appreciated that each and every dimension listed herein is meant to serve as a working example and not to limit the present disclosure to the given dimension(s).

Using stopper 40 of FIG. 5, it is contemplated that the user will squeeze pump 30 until the air diffuses into the wine, after which additional air migrates out of the wine and collects at the top of wine bottle 50. Additional squeezes at this point may cause the air at the top of wine bottle to become pressurized. The user may feel the air pressurization, which will tell the user that no additional squeezes of pump 30 are necessary. Such feedback may be used as an alternative or in addition to indicia 38 on squeezable portion 32 of pump, which as described above can let the user know how many squeezes of pump 30 to make and/or how long to cap the air within bottle 50 via aerator 10 before removing the aerator.

As illustrated in FIG. 5, stopper 40 is generally conically shaped, like a wine bottle cork. Due to the different diameters for lips and necks 52 for different wine bottles 50, it is contemplated to angle the conical shape of stopper 40 more severely and to lengthen the stopper so that the stopper has a diameter somewhere along is conical length that will sealingly but removeably fit into any, or virtually any, wine bottle lip 52. Thus it is contemplated to make angle θ in FIG. 5 be from about five degrees to about thirty-five degrees. The length of the conical section can be from about one inch (2.5 cm) to four inches (10 cm).

Figure 6A:
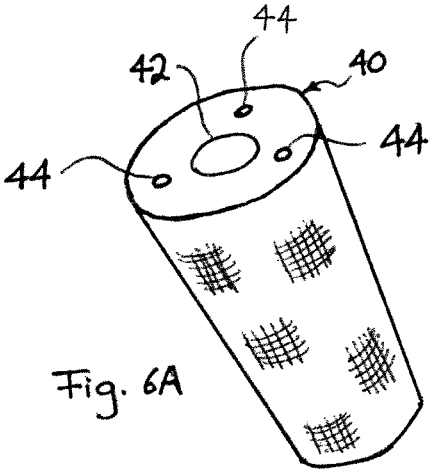
FIGS. 6A and 6B are top and bottom perspective views, respectively, of another embodiment for a stopper or cork useable with any wine aerator or breathing apparatus described herein.
Figure 6B:
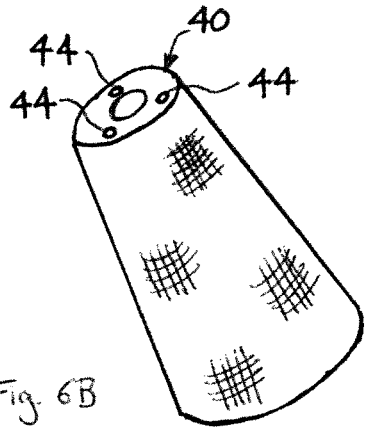

Referring now to FIGS. 6A and 6B, an alternative stopper 40 is illustrated from its top side (FIG. 6A) and its bottom side (FIG. 6B). Stopper 40 of FIGS. 6A and 6B includes aperture 42 as described above, including all of its alternatives discussed in connection with FIG. 5. Stopper 40 includes at least one additional vent aperture or bore 44. Vent apertures or bores 44 can be formed via any of the techniques described above for aperture 42, e.g., formed with stopper 40 or machined into stopper 40. Vent apertures 44 can have a smaller diameter than that of aperture 42, e.g., on the order of 0.063 inch (1.6 mm) diameter.

Vent apertures 44 allow air, or a certain percentage thereof, coming from pump 30, through the wine and migrating into the top of bottle 50 to vent to atmosphere. Air pressure at the top of bottle 50 accordingly does not build or builds minimally. Here again, indicia 38 can tell the user how many squeezes of pump 30 to make and/or how long to leave the bottle capped via stopper 40.

Figure 7:
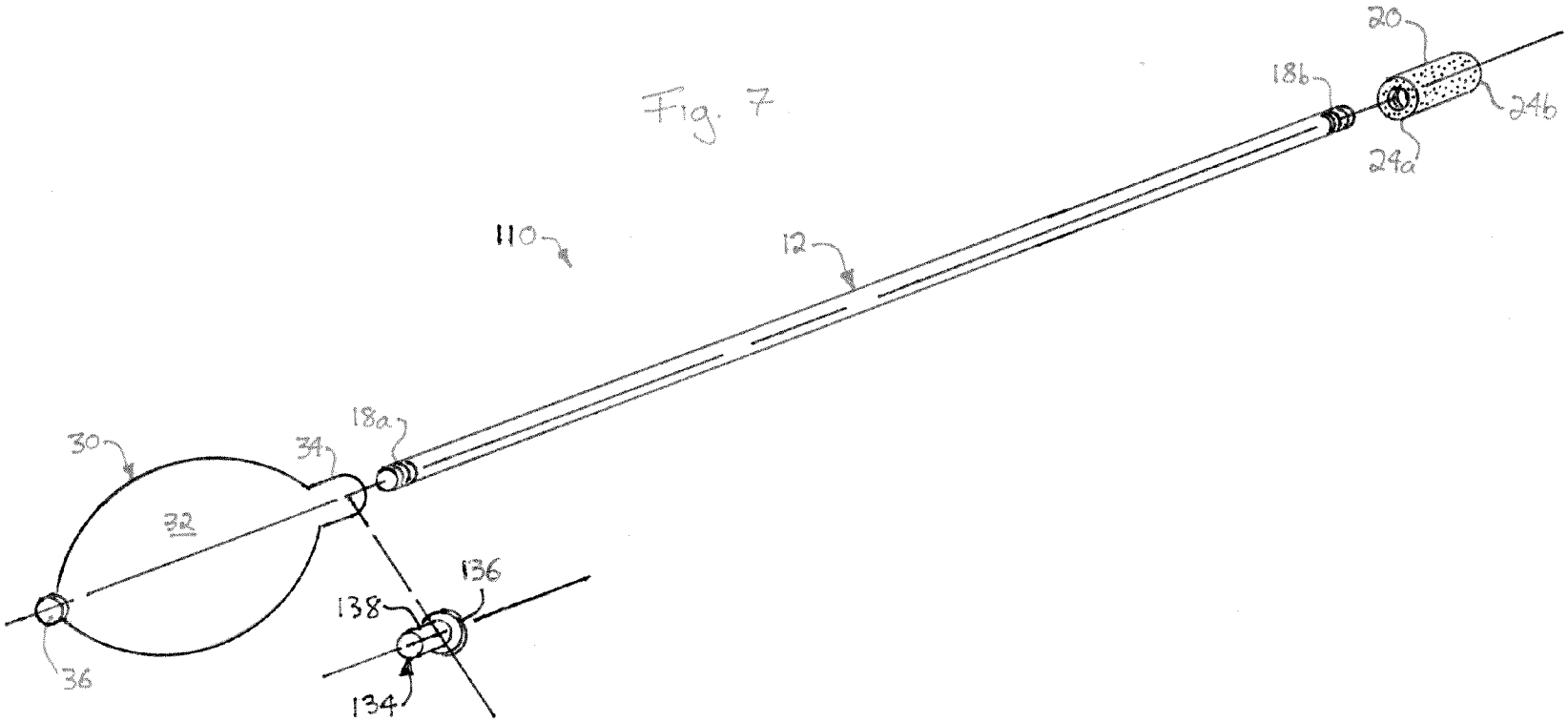
FIG. 7 is a perspective view illustrating another primary embodiment for a wine aerator or breathing apparatus of the present disclosure.

Referring now to FIG. 7, another primary embodiment for the aerator of the present disclosure is illustrated by aerator 110. Aerator 110 includes a tube 12 having proximal end 18*a* and distal end 18*b* as discussed above. Tube 12 can be a stainless steel, e.g., type 304 or 316 stainless steel tube having an outer diameter of 0.250 inch (6.4 mm) or be of a like metric size, such as a six mm outer diameter tube. In the illustrated embodiment, proximal end 18*a* and distal end 18*b* are threaded. For example, the threads can be ¼-20. If a metric tube is provided, the threads can be of a corresponding metric size and pitch. Tube 12 is of a suitable thickness to receive threads. For example, the 0.250 inch (6.4 mm) outer diameter tube can have an 0.065 inch (1.7 mm) thick wall, leaving a 0.120 inch (3.0 mm) hole through which pumped air travels. Finer threads, such as ¼-28 or ¼-32 straight threads or the metric equivalent, may be used alternatively.

In the illustrated embodiment, threaded distal end 18*b* receives diffuser 20, which can likewise be made of type 304 or 316 stainless steel. Diffuser 20 is a porous cup or porous capped tube segment, formed via any known method, such as via a sintered or powdered metal process. The pore size can, for example, be less than one-hundred microns, such as ten microns, five microns, two microns, one micron or less than one micron, such as a half-micron or a fraction of a micron. Smaller pore sizes make smaller air bubbles, which helps the air to diffuse into the wine.

As illustrated, cup diffuser 20 has an open, threaded end 24*a* and a distal capped end 24*b*. Open threaded end 24*a* includes a female thread sized to threadingly and releaseably engage distal male threaded end 18*b*. Threaded end 24*a* may accordingly have a female ¼-20 straight thread to mate with tube 12. Finer threads, such as ¼-28 or ¼-32 straight threads or the metric equivalent may be used alternatively. If tube 12 is 0.250 inch (6.4 mm) outer diameter, the outer diameter of diffuser 20 can be 0.375 inch (9.5 mm). The inner diameter of threaded end 24*a* prior to it being threaded can be 0.196 inch (5.0 mm). The length of diffuser 20 is in one embodiment one inch (25.4 mm), 0.250 inch (6.4 mm) of which is threaded.

The total length of tube 12 can be 11.25 inches (28.6 cm), so that when the one inch (25.4 mm) diffuser is threaded onto tube 12, the total length of assembled tube 12 and diffuser 20 is one foot (30.5 cm). Capped end 24*b* can be flat or rounded. Threaded cup diffuser 20 threads onto and off of tube 12 for thorough cleaning of tube 12 and diffuser 20, and for easy reengagement.

In an alternative embodiment, the porous metal cup diffuser is welded to distal end 18*b* of diffuser, which now does not need to be threaded. Here, the outer diameters of tube 12 and diffuser 20 can be the same. The wall thicknesses of the tube and diffuser can also be thinner because the tube walls do not need to support threads. The overall outside diameter of the tube and diffuser can likewise be smaller, e.g., 0.188 inch (4.8 mm). A smaller diameter tube and diffuser are desirable because less wine is displaced via the insertion of tube 12 and diffuser 20.

Bulb pump 30 for aerator 110 can be any of the bulbs including all alternatives for bulb 30 described above in connection with aerator 10. As illustrated in FIG. 7, attachment end 34 of bulb pump 30 can receive a female threaded insert 134 having female threads that threadingly and releaseably attach to the male threads of proximal end 18*a* of tube 12. For example, female threaded insert 134 can have female ¼-20 straight threads to mate with male ¼-20 straight threads provided at proximal end 18*a* of tube 12. Finer threads, such as ¼-28 or ¼-32 straight threads or the metric equivalent may be used alternatively. Female threaded insert 134 can be made of any of the materials discussed above for tube 12 and/or diffuser 20, such as plastic, rubber or metal, e.g., stainless steel, aluminum or brass. Female threaded insert 134 can be knurled, e.g., diamond knurled, have catches, have soft or compressible spots, be ribbed, be threaded on the outside, be slotted, be segmented, and/or have adhesive so as to fit snuggly, removeably or permanently, within attachment end 34 of pump 30.

In one embodiment, female threaded insert 134 includes a flange 136 at its tube receiving end. Bulb insertion portion 138 of female threaded insert 134 is sized to press-fit into attachment end 34 of pump 30 and includes knurls or other mechanical obstructions that resist the turning of female threaded insert 134 within the attachment end 34 of pump 30. However, if one overtightens tube 12 into female threaded insert 134, tube 12 and threaded insert 134 will collectively turn within the, e.g., plastic or rubber attachment end 34 of pump 30. If so, flange 136 will prevent female threaded insert 134 from threading or sliding through attachment end 34 of pump 30 and extending into squeezable portion of pump 30. It is also contemplated to allow the user to pull tube 12 and female threaded insert 134 out of attachment end 34 of pump 30, by accident or on purpose, e.g., for cleaning, without permanently damaging aerator 110. After cleaning, female threaded insert 134 can be press-fitted again into attachment end 34 of pump 30, rendering aerator 10 fully operational. The press-fit of attachment end 34 to bulb insertion portion 138 of female threaded insert 134 is strong enough, even after repeated press-fittings of insert 134 into pump 30, such that insert 134 will not spin within bulb 30 when it is attempted to unthread tube 12 from insert 134. It is believed that the above configuration allows for the over-tightening and the undue pushing or pulling of tube 12 relative to bulb 30 without damaging aerator 10, providing a robust and long lasting device.

Telescoping Aerators

Figure 8A:
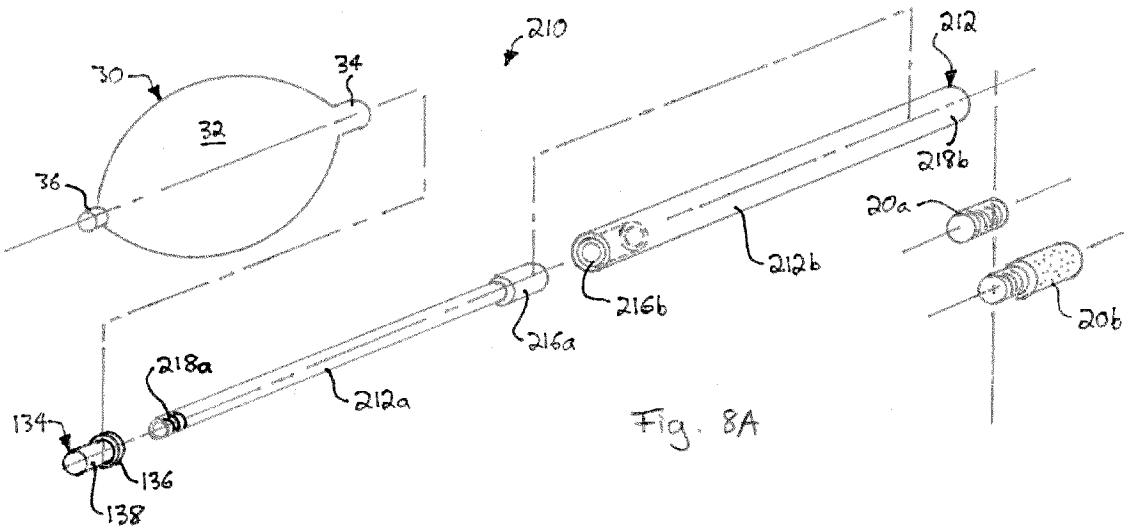
FIG. 8A is a perspective view illustrating one telescoping embodiment for a wine aerator or breathing apparatus of the present disclosure.
Figure 8B:
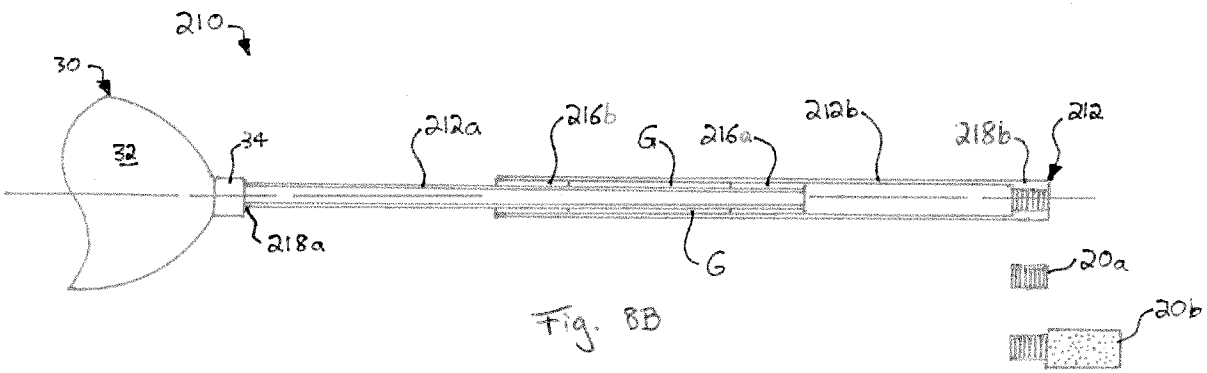
FIG. 8B is a sectioned view of the telescoping wine aerator or breathing apparatus of FIG. 8A.

Referring now to FIGS. 8A and 8B, yet another primary embodiment for the aerator of the present disclosure is illustrated by telescoping aerator 210. Telescoping aerator 210 can be shortened when not in use, which may be useful for travel or in a restaurant. In a restaurant, for example, a waiter or waitress can store aerator 210 in its retracted position until needed, upon which the aerator is expanded for use. The retracted position, or an intermediate position between the fully retracted position and the fully expanded position, may be desirable under any location or circumstance of use for single glasses of wine or for smaller bottles of wine.

Bulb pump 30 for aerator 210 can be any of the bulbs including all alternatives for bulb 30 described above in connection with aerators 10 and 110. As illustrated in FIG. 8A, attachment end 34 of bulb 30 can receive a female threaded insert 134 having female threads that threadingly and releaseably attach to the male threads of proximal end 218*a* of tube segment 212*a*. Female threaded insert 134 for aerator 210 includes flange 136 and bulb insertion portion 138, including all alternative structures discussed above for insert 134, and can be made of any of the materials discussed above.

First or proximal tube segment 212*a* is telescopingly engaged with second or distal tube segment 212*b* to form an overall tube 212. Tube segments 212*a* and 212*b* when fully extended relative to each other can be of approximately the same length as tubes 12 of aerators 10 and 110. Alternatively, the overall fully extended length of tubes 212*a* and 212*b* can be longer than tubes 12 of aerators 10 and 110. For example, each of tube segments 212*a* and 212*b* can be approximately the same length as tubes 12 of aerators 10 and 110, effectively doubling the overall length from that of aerators 10 and 110. Thus another use for telescoping aerator 210 is for larger bottles of wine, such as magnums of wine. A single tube 12 can also be made larger for such applications.

First tube segment 212*a* terminates at its distal end with an external collar 216*a* that is affixed to the outside diameter of tube segment 212*a*. Similarly, second tube segment 212*b* begins at its proximal end with an internal collar 216*b* affixed to the inside diameter of tube segment 212*b*. Collars 216*a* and 216*b* are in one embodiment of the same internal and external diameter and are sized to allow for slidingly sealed contact between tube segments 212*a* and 212*b*. Collars 216*a* and 216*b* can be press-fitted and/or adhered to their respective tube segments 212*a* and 212*b*.

Tube segment 212*a* can be a stainless steel, e.g., type 304 or 316 stainless steel tubing having an outer diameter of 0.250 inch (6.4 mm) or be of a like metric size, such as a six mm outer diameter tube size. In the illustrated embodiment, proximal end 218*a* is male threaded. For example, the threads can be ¼-20 straight male threads. If a metric tube is provided, the male threads are of a corresponding metric size and pitch. Finer threads, such as ¼-28 or ¼-32 straight threads or the metric equivalent may be used alternatively. Tube segment 212*a* is of a suitable thickness to receive threads. For example, the 0.250 inch (6.4 mm) outer diameter tube can have a 0.065 inch (1.7 mm) thick wall, leaving a 0.120 inch (3.0 mm) hole through which pumped air travels.

Tube segment 212*b* can likewise be a stainless steel, e.g., type 304 or 316 stainless steel tubing having an outer diameter of 0.375 inch (9.5 mm) or be of a like metric size, such as a nine or ten mm outer diameter tube size. In the illustrated embodiment, distal end 218*b* is female threaded. For example, the threads can be ¼-20 straight female threads. If a metric tube is provided, the female threads are of a corresponding metric size and pitch. Finer threads, such as ¼-28 or ¼-32 straight threads or the metric equivalent may be used alternatively. Tube segment 212*b*, at least at distal end 218*b*, is of a suitable thickness to receive threads. For example, the 0.375 inch (9.5 mm) outer diameter tube can have an (integrally formed or added by an insert) inner diameter at distal end 218*b* of 0.196 inch (5.0 mm), which is suitable for female ¼-20 straight female threads. Finer threads, such as ¼-28 or ¼-32 straight threads or the metric equivalent may be used alternatively. The remainder of tube segment 212*b* can be of a thinner wall thickness, such as 0.031 inch (0.80 mm), leaving an inner diameter for all but distal end 218*b* of tube segment 212*b* of 0.313 inch (8.0 mm). In an embodiment, a threaded insert, such as threaded insert 134, which can have an end-of-travel flange 136, can be inserted into and attached permanently to distal end 218*b* of tube segment 212*b*. Here, tube segment 212*b* can be of a uniform inner diameter, e.g., 0.313 inch (8.0 mm) inner diameter, and receive threaded insert 134 at its distal end 218*b*, the threaded insert being sized to attach permanently into a 0.313 inch (8.0 mm) inner diameter metal tube.

The 0.313 inch (8.0 mm) inner diameter of tube segment 212*b* (except for threaded end 218*b*) slides over the 0.250 inch (6.4 mm) tube segment 212*a*, leaving a 0.031 inch (0.80 mm) gap G (FIG. 8B) on either side of tube segment 212*a*. The 0.031 inch (0.80 mm) gap G forms the approximate wall thickness for both collars 216*a* and 216*b*. Thus, in one implementation, collars 216*a* and 216*b* have an outer diameter of or about 0.313 inch (8.0 mm) and an inner diameter of or about 0.250 inch (6.4 mm).

Collars 216*a* and 216*b* can be made of metal, plastic or rubber and in one embodiment are nylon. A smooth, tough but slightly compressible or pliable material, such as nylon, is a good material for collars 216*a* and 216*b*. If the material of collars 216*a* and 216*b* is more compliant or compressible, the thickness of collars 216*a* and 216*b* may be slightly bigger than the gap G distance (e.g., ten percent bigger), so that collars 216*a* and 216*b* ensure a seal is formed at two places between the inner diameter tube segment 212*b* and the outer diameter of tube segment 212*a*. If the material of collars 216*a* and 216*b* is instead more rigid and incompressible, the thickness of collars 216*a* and 216*b* may be the same as the gap G distance or even slightly smaller than the gap G distance (e.g., ten percent smaller), so that it is ensured that inner diameter tube segment 212*b* can readily slide along the outer diameter of tube segment 212*a* and that collars 216*a* and 216*b* do not present undue resistance to such sliding.

FIGS. 8A and 8B illustrate that aerator 210 can use different diffusers 20*a* and 20*b*. Diffusers 20*a* and 20*b* can be made of any of the materials discussed above for diffuser 20, such as a polymer material, wood, cork, rubber, metal or combinations thereof. In one embodiment, diffusers 20*a* and 20*b* are a stainless steel (e.g., type 304 or 316 stainless steel) porous cups or porous capped tube segments. The pore size can, for example, be less than one-hundred microns, such as ten microns, five microns, two microns, one micron or less than one micron, such as a half-micron or fraction of a micron. Smaller pore sizes make smaller air bubbles, which helps the air to diffuse into the wine. Diffuser 20*a* is itself threaded, e.g., male threaded, to fit into threaded end 218*b* of tube segment 212*b*. Although not illustrated, diffuser 20*a* can have at its distal end a flathead slot or Phillips head slot, enabling diffuser 20*a* to be inserted and/or removed via a screwdriver. Diffuser 20*b* includes a distal diffusing portion formed with or connected to a proximal male threaded, non-diffusing portion. The outer diameter of the distal diffusing portion can be the same as and match the outer diameter of tube segment 212*b* (e.g., 0.375 inch (9.5 mm)). The threads of diffusers 20*a* and 20*b* can for example be ¼-20 straight male threads that thread into the female threaded end 218*b* of tube segment 212*b*. Finer threads, such as ¼-28 or ¼-32 straight threads or the metric equivalent may be used alternatively.

FIG. 8B illustrates that when assembled, collar 216*b* of distal tube segment 212*b* resides on the proximal or bulb pump 30 side of collar 216*a* of proximal tube segment 212*a*. Collar 216*a* of proximal tube segment 212*a* accordingly resides on the distal or diffuser 20*a*, 20*b* side of collar 216*b* of distal tube segment 212*b*. Thus when tube segments 212*a* and 212*b* are pulled apart, collar 216*a* abuts collar 216*b*, marking the end of extension travel and the full extension of aerator 210. The tube segments 212*a* and 212*b* can be sized such that when they are pushed together, one of three situations occur: (i) collar 216*b* abuts flange 136 of insert 134 at proximal end 218*a* of tube segment 212*a* before collar 216*a* abuts the thickened (e.g., insert bearing) distal end 218*b* of tube segment 212*b*, marking the end of retraction travel and the full retraction of aerator 210; (ii) collar 216*a* abuts the thickened (e.g., insert bearing) distal end 218*b* of tube segment 212*b* before collar 216*b* abuts flange 136 of insert 134 at proximal end 218*a* of tube segment 212*a*, again marking the end of retraction travel and the full retraction of aerator 210; or (iii) collar 216*b* abuts flange 136 of insert 134 at proximal end 218*a* of tube segment 212*a* at the same time that collar 216*a* abuts the thickened (e.g., insert bearing) distal end 218*b* of tube segment 212*b*, again marking the end of retraction travel and the full retraction of aerator 210.

Collars 216*a* and 216*b* are of a sufficient length (e.g., 0.250 inch (6.35 mm), 0.375 inch (9.53 mm) or 0.500 inch (12.7 mm)), such that tube segments 212*a* and 212*b* are stable relative to each other, e.g., do not cock or pivot relative to each other, even when tube segments 212*a* and 212*b* are fully extended. The porous structure of diffusers 20*a* and 20*b* enables air to be squeezed or pushed out of the diffusers when tube segments 212*a* and 212*b* are retracted or pushed together. The porous structure of diffusers 20*a* and 20*b* also enables air to be pulled in through the diffusers when tube segments 212*a* and 212*b* are expanded or pulled apart. The user therefore does not have to fight unduly against a build-up of positive pressure within tube segments 212*a* and 212*b* when retracting the segments or negative pressure within tube segments 212*a* and 212*b* when expanding the segments. To prevent wine or other liquid from being sucked into aerator 210 when tube segments 212*a* and 212*b* are pulled apart or expanded, it is contemplated to provide instructions to the user not to do so when diffuser 20*a* or 20*b* is inserted into wine or other liquid. Nevertheless, overall tube 212 can be removed from bulb pump 30 and/or diffuser 20*a* or 20*b* can be removed from overall tube 212 and reassembled easily to allow any liquid trapped within overall tube 212 to be drained and to thereafter thoroughly clean and disinfect the inside of overall tube 212.

The mode of providing the thickened, female threaded distal end 218*b* of distal tube segment 212*b* can dictate how collars 216*a* and 216*b* are fixed to tube segments 212*a* and 212*b*, respectively. For example, tube segment 212*b* may be provided originally as an overall thickened tube. For example, tube segment 212*b* can be provided originally as a 0.375 inch (9.5 mm) outer diameter tube with an inner diameter throughout of 0.196 inch (5.0 mm), which is suitable for forming ¼-20 female threads (or ¼-28 or ¼-32 straight threads or the metric equivalent) as has been described herein. The 0.196 inch (5.0 mm) inner diameter can then be drilled or bored out to 0.313 inch (8.0 mm) for all of tube segment 212*b* except the distal end 218*b* of distal tube segment 212*b*, which can be left as 0.196 inch (5.0 mm) to receive the ¼-20 female threads (or ¼-28 or ¼-32 straight threads or the metric equivalent).

If tube segment 212*b* is provided originally as an overall thickened tube, or if the diffuser is welded or otherwise permanently affixed to distal end 218*b* of distal tube segment 212*b*, collar 216*b* can be placed loosely on proximal tube segment 212*a*, after which the inner surface of collar 216*a* is adhered or otherwise fixed to the distal end of proximal tube segment 212*a* as illustrated in FIGS. 8A and 8B. When the inner surface of collar 216*a* is dried or cured to the distal end of proximal tube segment 212*a*, tube segment 212*b* is slid over collar 216*a*. The inner surface of the proximal end of tube segment 212*b* can be coated with an adhesive and then slid over the outer surface of collar 216*b* to secure the inner surface of the proximal end of tube segment 212*b* to the outer surface of collar 216*b*. Or, the outer surface of collar 216*b* can be coated with an adhesive, after which the inner surface of the proximal end of tube segment 212*b* is slid over the outer surface of collar 216*b*, cured and secured.

In another mode of providing the thickened, female threaded distal end 218*b* of distal tube segment 212*b*, tube segment 212*b* is provided originally as an overall thinner tube. For example, tube segment 212*b* can be provided originally as a 0.375 inch (9.5 mm) outer diameter tube with an inner diameter throughout of 0.313 inch (8.0 mm). Here, a female threaded insert 134, such as the one illustrated in FIG. 8A, e.g., a ¼-20 female threaded insert (or ¼-28 or ¼-32 straight threads or the metric equivalent), is press-fitted, mechanically locked, and/or adhered into threaded distal end 218*b* of distal tube segment 212*b*. In this embodiment, the inner surface of collar 216*a* can be adhered to or otherwise fixed to the distal end of the outer surface proximal tube segment 212*a*, while the outer surface of collar 216*b* is separately adhered to or otherwise fixed to the proximal end of the inner surface of tube segment 212*b*. Then, distal tube segment 212*b* can be slid from left to right in FIGS. 8A and 8B over proximal tube segment 212*a*. As soon as distal end 218*b* of distal tube segment 212*b* clears collar 216*a* fixed at the distal end of proximal tube segment 212*a*, threaded insert 134 can be fixed to distal end 218*b* of distal tube segment 212*b*.

While telescoping aerator 210 is illustrated as having two tube segments 212*a* and 212*b*, it is contemplated for telescoping aerator 210 to instead have three or more sections. For example, two larger outer tubes of the same outer diameter and wall thickness can be telescopically connected to an inner smaller diameter tube. Here, the two outer tubes meet each other over the inner tube when the alternative telescoping aerator is in its most contracted condition. The two outer tubes are pulled away from each other to the ends of the smaller diameter inner tube when the alternative telescoping aerator is in its most expanded condition. Two sets of collars, like collars 216*a* and 216*b*, are provided in the manner discussed above for telescoping aerator 210, one set for a first end of the inner tube and a first one of the larger outer tubes, the other set for a second end of the inner tube and second one of the larger outer tubes.

Bulb Pump And Tube Connection Alternatives

Figure 9:
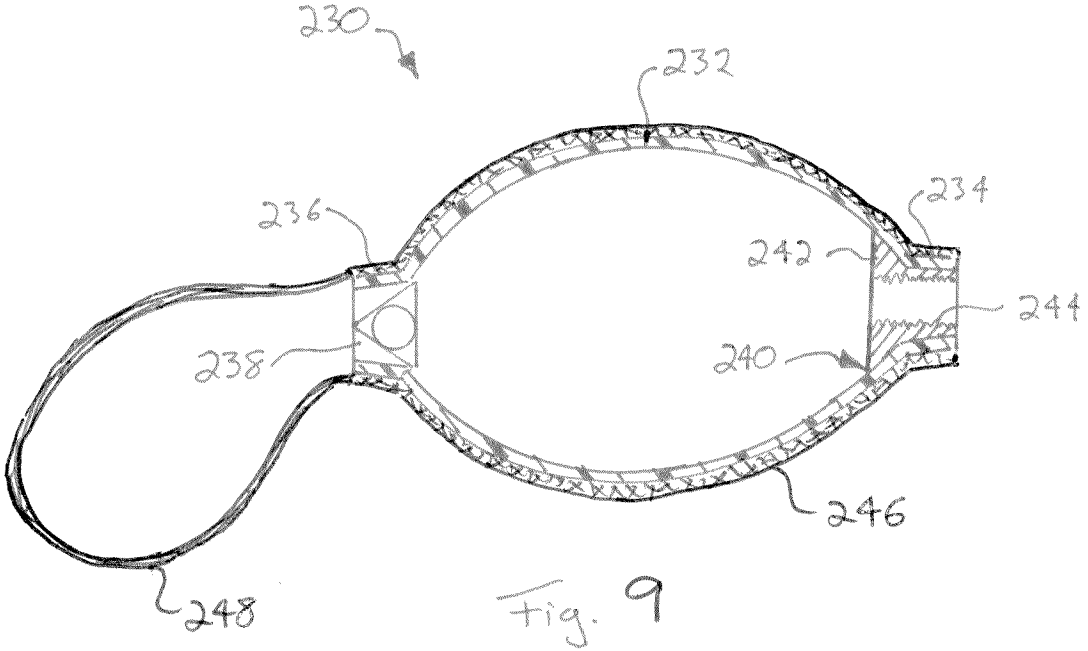
FIG. 9 is a sectioned elevation view of one embodiment for a bulb pump of the present disclosure.

Referring now to FIG. 9, one alternative embodiment for a bulb or hand air pump is illustrated by pump 230, which can be used with any of the aeration devices discussed herein. Squeezable portion 232 of pump 230 can be made of any one or more of rubber or plastic, such as latex, silicone or polyvinylchloride ("PVC"). Squeezable portion 232 in the illustrated embodiment has a bulb shape. The bulb shape can be rounder, like a tennis ball or flatter, like an American football or rugby ball. Squeezable portion 232 can still further alternatively be egg-shaped, where the narrow end of the egg resides at attachment end 234, or where the narrow end of the egg resides at air intake end 236. Air intake end 236 includes a one-way or check valve 238 as illustrated. Air can enter squeezable portion 232 through check valve 238 but cannot leave squeezable portion 232 through check valve 238.

Attachment end 234 of air pump 230 includes a threaded plug or insert 240, which can be metal, such as steel or stainless steel, plastic or rubber, such as any of the plastics or rubbers discussed herein. Plug or insert 240 can inserted and possibly adhered after squeezable portion 232 is formed or be molded into the squeezable portion as squeezable portion 232 is formed. Threaded plug or insert 240 includes a flange portion 242 and a threaded portion 244. Flange portion 242 is contoured in an embodiment to the inner shape of the attachment side of squeezable portion 232. Flange portion 242 is alternatively disk-shaped. Flange portion 242 can be adhered to and/or molded into the attachment side of squeezable portion 232. Flange portion 242 also serves as a stiffener so that bulb 230 does not deflect as much due to the weight or moment applied by tube 12 and diffuser 20. Threaded portion 244 can have ¼-20 female threads. If a metric tube is provided, the threads can be of a corresponding metric size and pitch. Finer threads, such as ¼-28 or ¼-32 straight female threads or the metric equivalent, may be used alternatively.

FIG. 9 also illustrates that any of the bulb pumps described herein, such as bulb pump 230, can be partly or virtually completely covered by a decorative sock or sleeve 246. Sock or sleeve 246 is flexible and moves with squeezable portion 232. Sock or sleeve 246 can be an expandable or stretchable, Spandex™ type material. In an embodiment sock or sleeve 246 be an open mesh, such as an open, nylon expandable mesh, where the bulb material may show through the mesh. FIG. 9 further illustrates that sock or sleeve 246 can form a loop or hanger 248, which can be multi-stranded or a braided yarn or string. Loop or hanger 248 enables the aerator to be hung when not in use.

Figure 10:
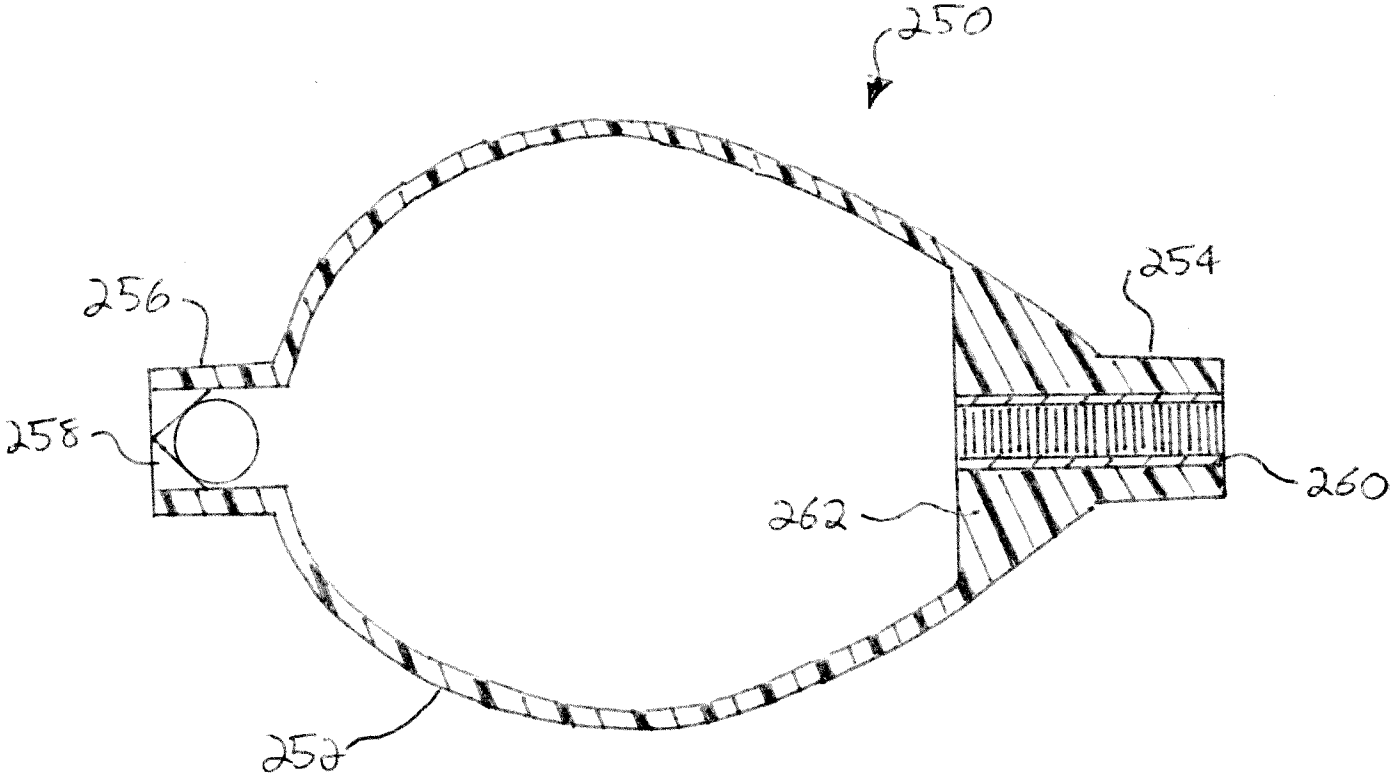
FIG. 10 is a sectioned elevation view of a second embodiment for a bulb pump of the present disclosure.

Referring now to FIG. 10, another alternative embodiment for a bulb or hand air pump is illustrated by pump 250, which can be used with any of the aeration devices discussed herein. Squeezable portion 252 of pump 250 can be made of any one or more of rubber or plastic, such as latex, silicone or polyvinylchloride ("PVC"). Squeezable portion 252 in the illustrated embodiment has a bulb shape. The bulb shape can be rounder, like a tennis ball or flatter, like an American football or rugby ball. Squeezable portion 252 can still further alternatively be egg-shaped, where the narrow end of the egg resides at attachment end 254, or where the narrow end of the egg resides at air intake end 256. Air intake end 256 includes a one-way or check valve 258 as illustrated, which operates as described above for check valve 238.

Attachment end 254 of air pump 250 includes a threaded plug or insert 260, which can be metal, such as steel or stainless steel, plastic or rubber, such as any of the plastics or rubbers discussed herein. Plug or insert 260 can be inserted and possibly adhered to squeezable portion 252 after portion 252 is formed or be molded with or into portion 252 as it is formed. Threaded plug or insert 260 can include a flange (not illustrated) at the attachment end 254 of pump 250. Threaded insert 260 can have ¼-20 female threads. If a metric tube is provided, the threads can be of a corresponding metric size and pitch. Finer threads, such as ¼-28 or ¼-32 straight female threads or the metric equivalent, may be used alternatively, for connecting to tube 12.

Squeezable portion 252 of bulb pump 250 includes a thickened or reinforced front end 262, which is molded as part of the squeezable portion. Thickened or reinforced front end 262 allows for threaded insert 260 and the corresponding threaded connection between tube 12 and the bulb pump to be longer and more robust. Thickened or reinforced front end 262 is sized in one embodiment to allow squeezable portion 252 to be fully squeezed shut. Thickened or reinforced front end 262 also serves as a stiffener so that bulb 250 does not deflect as much due to the weight or moment applied by tube 12 and diffuser 20.

Figures 11A, 11B:
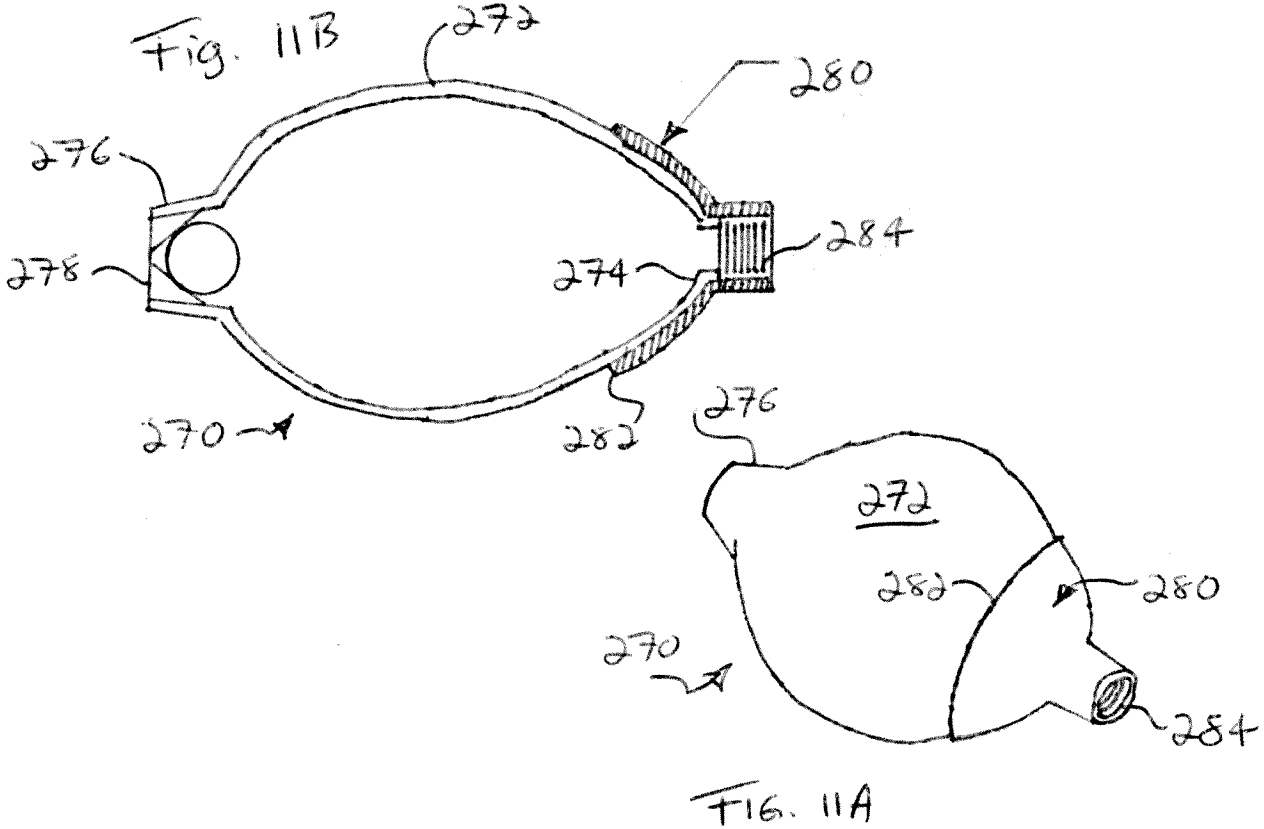
FIGS. 11A and 11B are perspective and sectioned elevation views, respectively, of a third embodiment for a bulb pump of the present disclosure.

Referring now to FIGS. 11A and 11B, a further alternative embodiment for a bulb or hand air pump is illustrated by pump 270, which can be used with any of the aeration devices discussed herein. Squeezable portion 272 of pump 270 can be made of any one or more of rubber or plastic, such as latex, silicone or polyvinylchloride ("PVC"). Squeezable portion 272 in the illustrated embodiment has a bulb shape. The bulb shape can be rounder, like a tennis ball or flatter, like an American football or rugby ball. Squeezable portion 272 can still further alternatively be egg-shaped, where the narrow end of the egg resides at attachment end 274, or where the narrow end of the egg resides at air intake end 276. Air intake end 276 includes a one-way or check valve 278 as illustrated, which operates as described above for check valve 238.

Bulb pump 270 includes a support cup 280, which can be metal, such as steel or stainless steel, such as brushed stainless steel 316, plastic or rubber, such as any of the plastics or rubbers discussed herein. Support cup 280 provides rigidity for the tube 12 plus a robust connection of tube 12 and bulb pump 270. Bulb front end 274 is cut or cropped except for a small tip that can serve as an o-ring for sealing to tube 12 when inserted. Glue or adhesive for fixing support cup 280 to squeezable portion 272 can be provided only at front end 274 of bulb 270 and not at a rear edge 282 of support cup 280 to allow for the full squeeze motion of squeezable portion 272. Support cup 280 can have a straight circular rear edge 282 as illustrated or have a lobed (FIG. 12A) or other decoratively shaped edge 282.

Support cup 280 also defines threads 284, which can be ¼-20 female threads, for receiving tube 12. If a metric tube is provided, the threads can be of a corresponding metric size and pitch. Finer threads, such as ¼-28 or ¼-32 straight female threads or the metric equivalent, may be used alternatively.

Figures 12A, 12B:
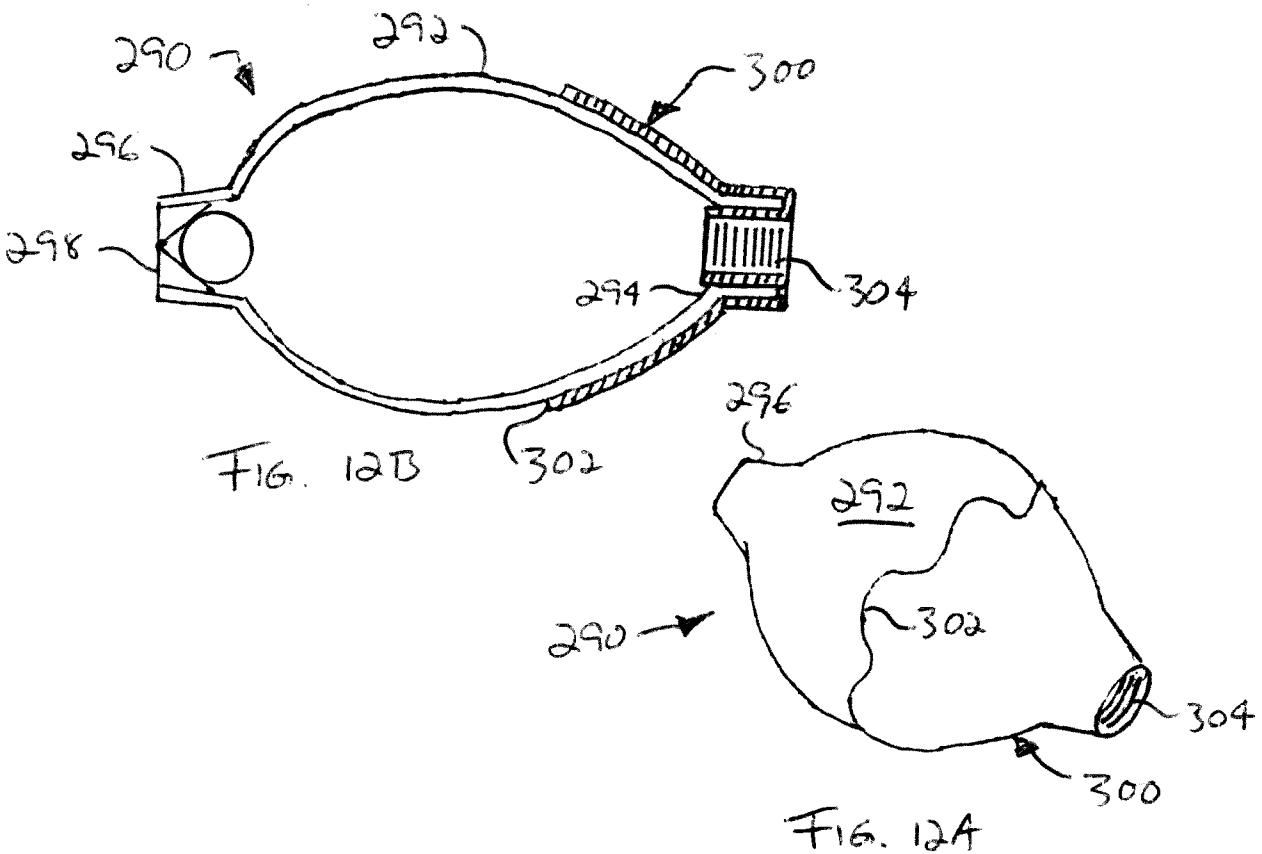
FIGS. 12A and 12B are perspective and sectioned elevation views, respectively, of a fourth embodiment for a bulb pump of the present disclosure.

Referring now to FIGS. 12A and 12B, a further alternative embodiment for a bulb or hand air pump is illustrated by pump 290, which can be used with any of the aeration devices discussed herein. Squeezable portion 292 of pump 290 can be made of any one or more of rubber or plastic, such as latex, silicone or polyvinylchloride ("PVC"). Squeezable portion 292 in the illustrated embodiment has a bulb shape. The bulb shape can be rounder, like a tennis ball or flatter, like an American football or rugby ball. Squeezable portion 292 can still further alternatively be egg-shaped, where the narrow end of the egg resides at attachment end 294, or where the narrow end of the egg resides at air intake end 296. Air intake end 296 includes a one-way or check valve 298 as illustrated, which operates as described above for check valve 238.

Bulb pump 290 includes an alternative support cup 300, which can be metal, such as steel or stainless steel, such as brushed stainless steel 316, plastic or rubber, such as any of the plastics or rubbers discussed herein. Support cup 300 likewise provides rigidity for the tube 12 plus a robust connection of tube 12 and bulb pump 290. Glue or adhesive for fixing support cup 300 to squeezable portion 292 can be provided only at front end 274 of bulb 270 and not at a rear edge 302 of support cup 300 to allow for the full squeeze motion of squeezable portion 292. Support cup 300 can have a curved or lobed rear edge 302 as illustrated in FIG. 12A or have a straight circular or other decoratively shaped edge 302.

Support cup 300 differs from cup 280 in that it bends around and covers both the inner surface and outer surface of bulb front or attachment end 294. The surface of support cup 300 that covers the inner surface of attachment end 294 of squeezable portion 292 also defines threads 304, which can be ¼-20 female threads, for receiving tube 12. If a metric tube is provided, the threads can be of a corresponding metric size and pitch. Finer threads, such as ¼-28 or ¼-32 straight female threads or the metric equivalent, may be used alternatively.

Figures 13A, 13B, 13C:
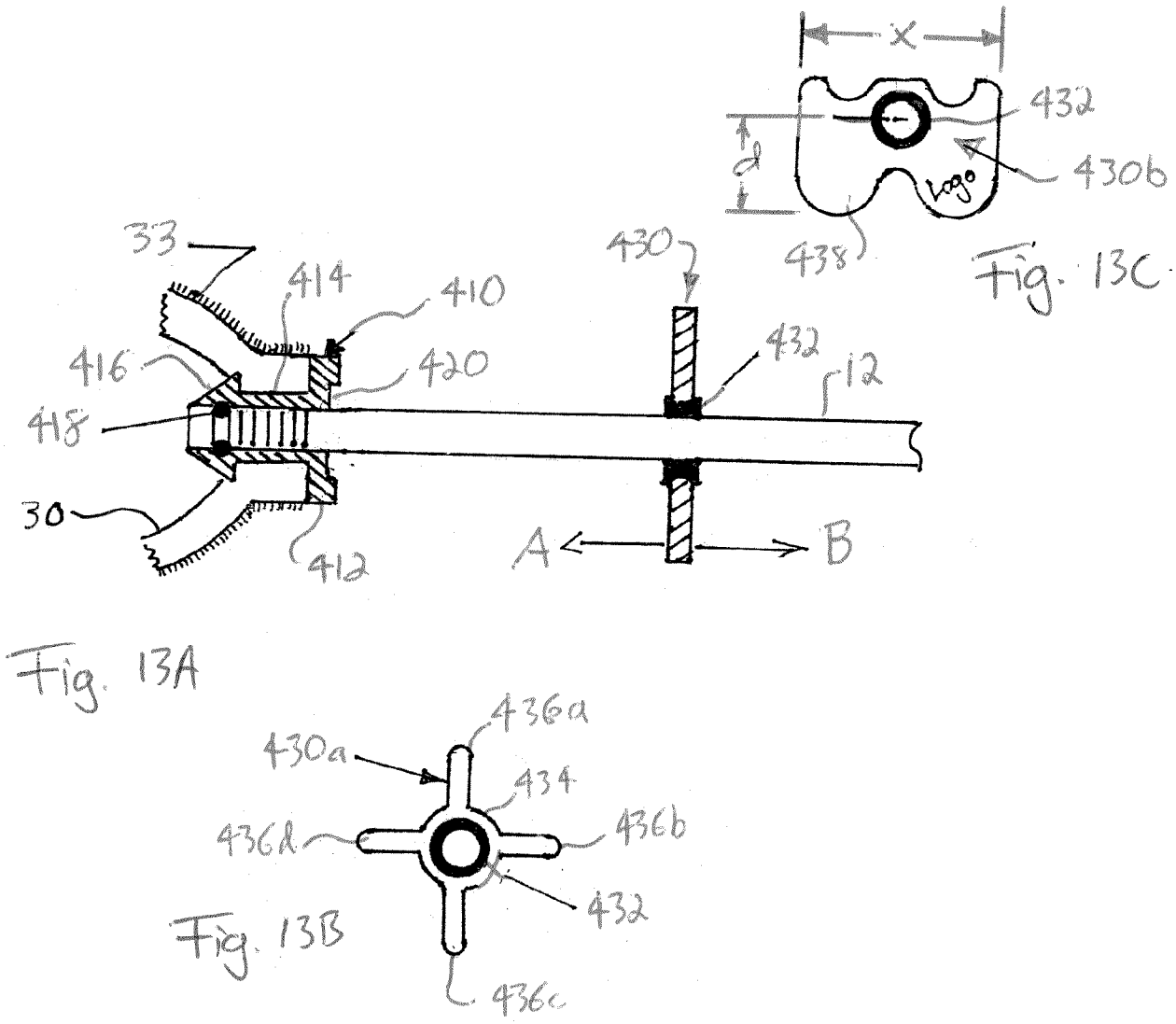
FIG. 13A is a sectioned elevation view of one embodiment for a tube and bulb connection of the present disclosure, which includes a translatable mechanism that doubles as a vent and a stand for the wine aerators or breathing apparatuses of the present disclosure.
FIGS. 13B and 13C are top plan views of different embodiments for the translatable mechanism discussed in connection with FIG. 13A.

Referring now to FIGS. 13A to 13C another embodiment for attaching any of the bulbs discussed herein, such as bulb 30 to tube 12 is illustrated. Bulb 30 in the illustrated embodiment is flocked or includes flocking 33, which can be applied in a silkscreened manner, such that logo information or other information or indicia can be viewed. FIG. 13A illustrates that bulb 30 is fitted with an insert 410, which includes a flanged section 412 and a barbed threaded section 414. Barb 416 of threaded section 414 digs into the inner wall of bulb 30 for a firm connection, which may not require an adhesive—although adhesive may be used if desired. Threaded section 414 in the illustrated embodiment seats an o-ring 418, such as a silicone o-ring, for providing a sealed connection to tube 12. Threaded section 414 can have ¼-20 female threads. If a metric tube is provided, the threads can be of a corresponding metric size and pitch. Finer threads, such as ¼-28 or ¼-32 straight female threads or the metric equivalent, may be used alternatively, for connecting to tube 12.

In the illustrated embodiment, flanged section 412 includes a milled slot or circular groove 420, which receives and seats an o-ring or grommet 432 or a vented washer or kickstand 430. O-ring or grommet 432 can likewise be silicone or other rubber or be a hard plastic piece. O-ring or grommet 432 in an embodiment fits tightly and sturdily enough to tube 12 so as to remain at a set position along tube 12, and such that a vented washer or kickstand 430 can support the weight of the aerator. Vented washer or kickstand 430 can thus be used to store the aerator when not used and also to hold tube 12 and the diffuser at a set position within a bottle for example.

In FIG. 13A, vented washer or kickstand 430 is slid in the direction of arrow A all the way against circular groove 420 of flanged section. This allows full extension of tube 12 within the bottle, but so that kickstand 430 rests on the top of the bottle so as to (i) prevents flocking 33 from entering the wine or spirits bottle, (ii) allow the user to still see the bubbles or aeration taking place in the bottle, beneath vented washer or kickstand 430, and (iii) allow gases released from the wine or spirits by the aeration to be vented. Vented washer or kickstand 430 can be slid in the direction of arrow B to a position along tube 12 so that the aerator can rest on the kickstand, so as to prevent the diffuser from touching a table or other surface between uses. Vented washer or kickstand 430 accordingly has multiple uses, and again, may be used additionally to hang the aerator when not in use.

FIGS. 13B and 13C illustrate different vented washer or kickstand versions 430*a* and 430*b*, respectively, which along with insert 410 can each be made of metal, such as steel or stainless steel, plastic or rubber, such as any of the plastics or rubbers discussed herein. Vented washer or kickstand 430*a* of FIG. 13B includes a circular ring 434 around grommet 432 and spokes 436*a* to 436*d* emanating from circular ring 434. Spokes 436*a* to 436*d* extend a distance in one embodiment that is roughly the same as the largest outer diameter of bulb 30, so that the aerator is substantially horizontal when set on a table. Vented washer or kickstand 430*b* of FIG. 13C includes a flange 438 around grommet 432. Flange 438 has a dimension "d" set to hold the aerator horizontal on a table and a distance "x" that is larger than the opening of a standard wine bottle. Vented washer or kickstand 430*b* is left open on the top to see into the bottle to view the bubbles or aeration.

Diffuser and Tube Connection Alternatives

Figure 14:
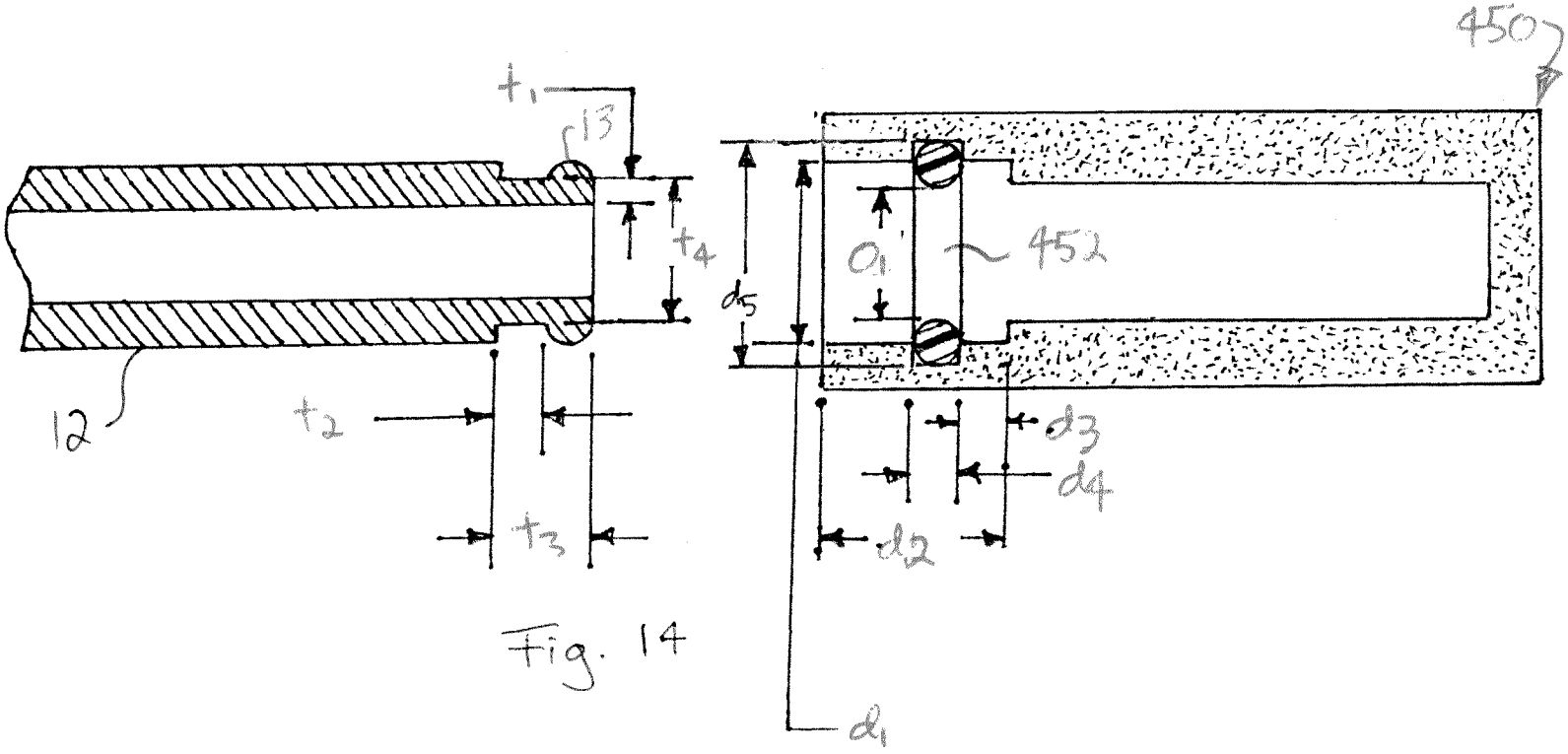
FIG. 14 is a sectioned elevation view of one alternative embodiment for a diffuser and tube connection of the present disclosure.

Referring now to FIG. 14, one embodiment for connecting a porous or sintered diffuser 450, having any of the structural and functional attributes discussed herein, to tube 12, without requiring threading, is illustrated. Tube 12 has a machined end with dimensions t1, t2, t3 and t4. Diffuser 450 has a molded or machined end having dimensions d1 to d5. Dimension d5 is sized to hold an o-ring 452, which can be a silicone or other material o-ring, and which has an inner diameter dimension o1. The dimensions t1, t4 and o1 are sized so as to compress o-ring 452 when tube 12 is inserted into diffuser 450. Dimensions t2, t3, d3 and d4 are sized so that (i) a lip 13 of tube 12 can seat within dimension d3 and (ii) dimension t3 seats over and compresses o-ring 452 when tube 12 is inserted into diffuser 450. Dimensions d1 and d2 are sized so that a section of un-machined tube 12 fits snugly into diffuser 450, providing rigidity to the connection. Lip 13 is rounded so that insertion and removal of tube 12 into and from diffuser 450 is smooth and does not harm the softer material of o-ring 452.

Figure 15:
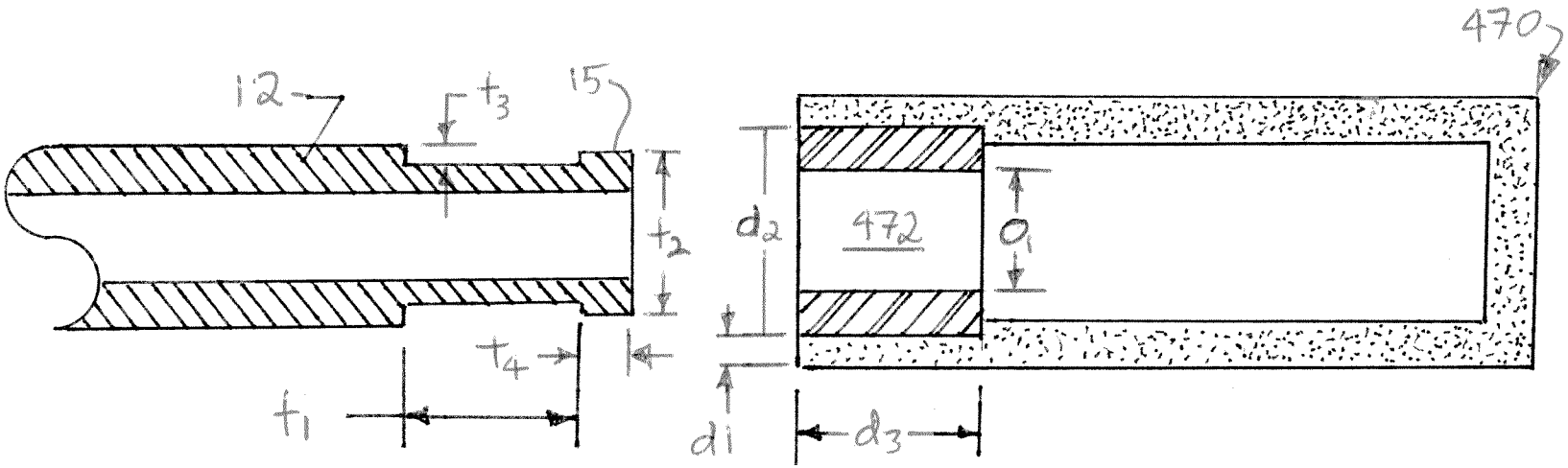
FIG. 15 is a sectioned elevation view of another alternative embodiment for a diffuser and tube connection of the present disclosure.

Referring now to FIG. 15, another embodiment for connecting a porous or sintered diffuser 470, having any of the structural and functional attributes discussed herein, to tube 12, without requiring threading, is illustrated. Tube 12 has a machined end with dimensions t1, t2, t3 and t4. Diffuser 470 has a molded or machined end having dimensions d1 to d3. Dimensions d1 and d2 are sized to hold an o-ring sleeve 472, which can be a silicone or other material o-ring, and which has an inner diameter dimension o1. The dimensions t3 and o1 are sized so as to compress o-ring 472 when tube 12 is inserted into diffuser 470. Dimensions t1 and t4 are sized so that (i) a lip 15 of tube 12 can slide past o-ring 472 and sit inside the o-ring and (ii) dimension t1 seats over and compresses o-ring 472 when tube 12 is inserted into diffuser 450. Dimension t2 is sized so that lip 15 can be inserted into and removed from 470 smoothly and without harming the softer material of o-ring 472. Dimension t2 is also sized so as to catch onto the inside of o-ring 472, so that tube 12 cannot come free from diffuser 470 too easily.

Single Glass Aerators with Protective Cases

Figure 16A:
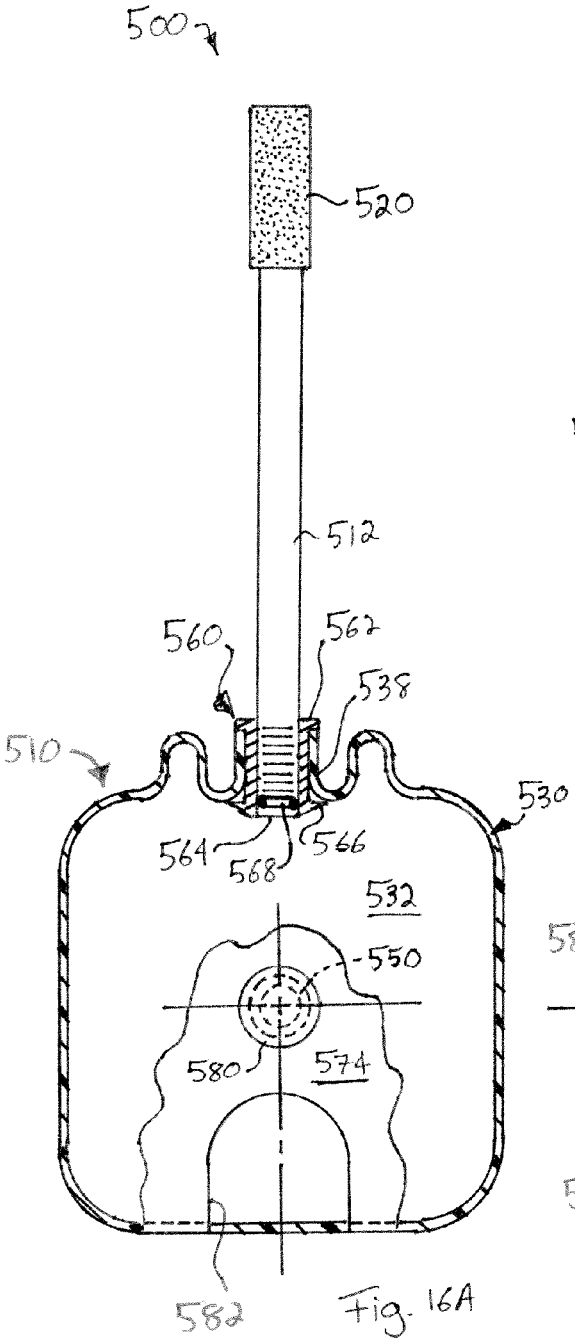
FIGS. 16A and 16B are front and side elevation sectioned views, respectively, of one embodiment for a standalone, glass-by-glass version of a wine or spirits aerator or breathing apparatus of the present disclosure.
Figure 16B:
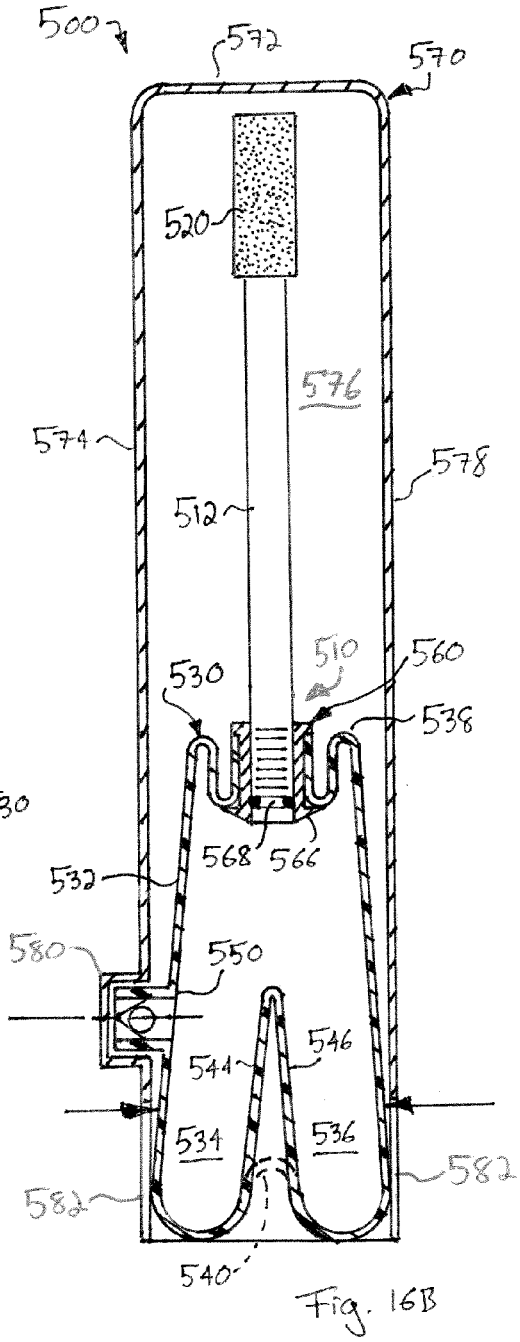

Referring now to FIGS. 16A and 16B, a single glass aeration assembly 500 is illustrated. Single glass aeration assembly 500 includes a single glass aerator 510 and a protective cover or traveling case 570. Aerator 510 includes a shortened tube 512 sized for single glass aeration. Shortened tube 512 can be made of any of the materials and alternatives discussed above for tubes 12 and 212, can be telescoping like tube 212, and can be about four inches (ten centimeters) or other suitable single glass distance long. Tube 512 can have any of the English or metric diameters and thread sizes discussed above for tubes 12 and 212.

Shortened tube 512 is connected to a porous or sintered metal diffuser 520. Diffuser 520 can alternatively be of a polymer material, wood, cork, rubber, metal or combinations thereof. In one embodiment, diffuser 520 is a stainless steel (e.g., type 304 or 316 stainless steel) porous cup or porous capped tube segment. The pore size can, for example, be less than one-hundred microns, such as ten microns, five microns, two microns, one micron or less than one micron, such as a half-micron or fraction of a micron. Smaller pore sizes make smaller air bubbles, which helps the air to diffuse into the wine. Diffuser 520 is in one embodiment generally impermeable to liquids. The small bubbles help the air to mix with and diffuse into the wine as opposed to simply migrating to the top of the bottle, without mixing. If diffuser 20 is left within a full bottle of wine for an extended period of time, the diffuser may eventually allow wine to seep through its walls. However, diffuser 520 is generally hydrophobic and will not allow wine or liquids to enter quickly. Diffuser 520 may be removeably connected to tube 512 via any of the structures and methods discussed in connection with FIGS. 1, 7, 8A, 8B, 14 and 15. Diffuser 520 is alternatively permanently fixed, e.g., welded or heat sealed, to tube 512.

The lower or proximal end of tube 512 is connected removeably in one embodiment to a standalone bulb pump 530. Standalone bulb pump 530 includes a standalone squeezable portion 532 having leg section 534 and leg section 536. Leg sections 534 and 536 can be separated in an accordion or bellows like manner via longer v-shaped inner walls 544 and 546. Leg sections 534 and 536 are separated alternatively by a shorter upside down u-shaped section 540 (shown in phantom line). In either case, leg sections 534 and 536 allow the entire aerator 510 to be placed on a table and sit upright as illustrated best in FIG. 16B, so that diffuser 520 extends vertically upwardly and is free from physical contact between uses.

Squeezable portion 532 includes a one-way check valve 550 placed in one of leg sections 534 and 536 as illustrated, which allows air to enter squeezable portion 532 when the squeezable portion expands naturally due to the elasticity of rubber bulb pump 530, which can be made of any materials discussed herein for the bulb pumps, such as latex, silicone (e.g., high grade silicone) or polyvinylchloride ("PVC"). Squeezable portion 532 can be flocked or left plain, e.g., for high grade silicone, and have any logo, information or indicia printed or silkscreened thereon. Squeezable portion 532 is manually squeezed closed in the direction of the arrows illustrated in FIG. 16B. For this purpose, the outer surfaces of leg sections 534 and 536 can be provided with rigid or semi-rigid plates, such as plastic plates, for pressing bellows-like leg sections 534 and 536 together. If leg sections are not provided, leg sections 534 and 536 will compress more in the middle as is the case with the other bulb pumps discussed herein. Both versions of squeezable portion 532 are expressly contemplated for aerator 510.

The top 538 of squeezable portion 532 is formed in one embodiment in a tub or basin shape, so as to collect any wine or spirits that may run down tube 512 when aerator 510 is set to rest as illustrated in FIGS. 16A and 16B. Tub or basin top 538 can be easily rinsed at the end of a night or period of use.

Tub or basin top 538 is fitted in the illustrated embodiment with an insert 560 for threadingly receiving tube 512. Insert 560 is similar to insert 410 discussed above. Insert 560 likewise includes a flanged section 562 and a barbed threaded section 564. Barb 566 of threaded section 564 digs into the inner wall of bulb pump top 538 for a firm connection, which may not require an adhesive—although adhesive may be used if desired. Threaded section 564 in the illustrated embodiment seats an o-ring 568, such as a silicone o-ring, for providing a sealed connection to tube 512. Threaded section 564 can have ¼-20 female threads. If a metric tube is provided, the threads can be of a corresponding metric size and pitch. Finer threads, such as ¼-28 or ¼-32 straight female threads or the metric equivalent, may be used alternatively, for connecting to tube 512.

Protective cover or traveling case 570 can be metal, plastic or rubber as desired. For example, case 570 can be brushed stainless steel. In the illustrated embodiment, case 570 has a top wall 572, front wall 574, side wall 576 (other sidewall sectioned away for illustration), rear wall 578 and an open bottom. Walls 572 to 578 can be flat, rounded or angled as desired for an aesthetic, yet rugged, protective finish. Front wall 574 includes an outwardly extending hollow catch 580 that is shaped and sized to hold check valve 550 extending outwardly from squeezable portion 532. The bottom of front wall 574 and the bottom of rear wall 578 each also define a user notch 582.

To insert aerator 510 lockingly into cover or traveling case 570, the user squeezes squeezable portion 532 closed such that check valve 550 can fit into the open end at the bottom of traveling case 570. To fully insert aerator 510 into case 570, the user's fingers can extend into user notches 582. When fully inserted, the user releases squeezable portion 532, which expands naturally, such that check valve 550 snaps into a locking position with hollow catch 580 of case 570. Aerator 510 remains in the locked position (check valve 550 snap-fitted into hollow catch 580) until it is desired to use the aerator. At the time of desired use, the user places his/her fingers into user notches 582 of case 570, squeezes squeezable portion 532 closed, unlocking check valve 550 from hollow catch 580, and enabling aerator 510 to be pulled free from traveling case 570.

Referring now to FIGS. 17A and 17B, single glass aerator 610 is of a bellows type similar to aerator 510 of FIGS. 16A and 16B. Aerator 610 can accordingly releaseably snap-fit into a protective cover or traveling case, such as case 570, as discussed above. Aerator 610 includes a shortened tube 612 sized for single glass aeration. Shortened tube 612 can be made of any of the materials and alternatives discussed above for tubes 12 and 212, can be telescoping like tube 212, and can be about four inches (ten centimeters) or other desired single glass distance long. Tube 612 can have any of the English or metric diameters and thread sizes discussed above for tubes 12 and 212. Shortened tube 612 is connected to a porous or sintered metal diffuser 620, which can be any of the porous stainless steel, wood, cork, or rubber diffusers discussed above. Diffuser 620 may be removeably connected to tube 612 via any of the structures and methods discussed in connection with FIGS. 1, 7, 8A, 8B, 14 and 15. Diffuser 620 is alternatively permanently fixed, e.g., welded or heat sealed, to tube 612.

The lower or proximal end of tube 612 is connected removeably in one embodiment to a standalone bulb pump 630, e.g., using a threaded insert in the same manner as discussed with aerator 510. Lower or proximal end of tube 612 is alternatively fixed to standalone bulb pump 630 in various manners discussed below with aerator 810. Standalone bulb pump 630 includes a standalone squeezable portion 632 having leg section 634 and leg section 636 as with aerator 510 discussed above. Leg sections 634 and 636 can be separated in an accordion or bellows like manner via longer v-shaped inner walls (such as walls 544 and 546 of aerator 510). Squeezable portion 632 includes a one-way check valve 650 placed in one of leg sections 634 and 636 as illustrated, which allows air to enter squeezable portion 632 when the squeezable portion expands naturally due to the elasticity of rubber bulb pump 630. Bulb pump 630 can be made of any materials discussed herein for the bulb pumps, such as latex, silicone (e.g., high grade silicone) or polyvinylchloride ("PVC"). Squeezable portion 632 can be flocked or left plain, e.g., for high grade silicone, and have any logo, information or indicia printed or silkscreened thereon.

One primary difference between aerators 510 and 610 is that the tub or basin top 538 of aerator 510 is replaced by a drip cup 638 for aerator 610. Drip cup 638 can be formed with or attached to tube 612. In an alternative embodiment, drip cup 638 is formed with or molded into bulb pump 630. Drip cup 638 serves the same purpose as tub or basin top 538 of aerator 510, namely, to catch wine or spirit drips between uses. It is thought that drip cup 638 may be able to have a larger drip catching area and thus be more effective than tub or basin top 538.

Squeezable portion 632 includes a one-way check valve 650 placed in one of leg sections 634 and 636 as illustrated, which allows air to enter squeezable portion 632 when the squeezable portion expands naturally due to the elasticity of rubber bulb pump 630. Pump 630 can be made of any materials discussed herein for the bulb pumps, such as latex, silicone (e.g., high grade silicone) or polyvinylchloride ("PVC"). Squeezable portion 632 is manually squeezed closed. For this purpose, the outer surfaces of leg sections 634 and 636 can as above be provided with rigid or semi-rigid plates, such as plastic plates, for pressing bellows-like leg sections 634 and 636 together. If rigid plates are not provided, leg sections 634 and 636 will compress more in the middle as is the case with the other bulb pumps discussed herein. Both versions of squeezable portion 632 are expressly contemplated for aerator 610.

Referring now to FIG. 18, single glass aerator 710 uses a bulb pump similar to bulb pump 30 discussed above. Aerator 710 compresses and expands and can accordingly releaseably snap-fit into a protective cover or traveling case as discussed above. Aerator 710 likewise includes a shortened tube 712 sized for single glass aeration. Shortened tube 712 can be made of any of the materials and alternatives discussed above for tubes 12 and 212, can be telescoping like tube 212, and can be about four inches (ten centimeters) or other suitable single glass distance long. Tube 712 can have any of the English or metric diameters and thread sizes discussed above for tubes 12 and 212. Shortened tube 712 is connected to a porous or sintered metal diffuser 720, which can be of any of the varieties and have any of the alternatives discussed repeatedly herein, and be removeably connected to tube 712 via any of the structures and methods discussed in connection with FIGS. 1, 7, 8A, 8B, 14 and 15. Diffuser 720 is alternatively permanently fixed, e.g., welded or heat sealed, to tube 612.

The lower or proximal end of tube 712 is connected removeably in one embodiment to a standalone bulb pump 730, e.g., using a threaded insert in the same manner as discussed with aerator 510. Lower or proximal end of tube 712 is alternatively fixed to standalone bulb pump 730 in various manners discussed below with aerator 810. Standalone bulb pump 730 is in one embodiment bulb pump 30 but turned so that it sits vertically with air intake end 36/736 residing beneath attachment end 34/734. Three or four legs 738 are molded into squeezable portion 732 of bulb pump 730 to enable the pump to reside vertically as illustrated in FIG. 18. Legs 738 can be open or be of solid material, such as of any material discussed herein for the bulb pumps, e.g., latex, silicone (e.g., high grade silicone) or polyvinylchloride ("PVC"). Squeezable portion 732 can be flocked or left plain, e.g., for high grade silicone, and have any logo, information or indicia printed or silkscreened thereon. Air intake end 736 includes a one-way check valve as has been described herein for forcing air to exit diffuser 720.

In the illustrated embodiment, aerator 710 includes a drip cup 740. Drip cup 740 can be formed with or attached to tube 712. In one embodiment, drip cup 740 is formed with or molded into bulb pump 730. Drip cup 740 serves the same purpose as tub or basin top 538 of aerator 510, namely, to catch wine or spirit drips between uses.

Referring now to FIG. 19A, yet another embodiment of a single glass wine or spirits aerator of the present disclosure is illustrated by aerator 810. Aerator 810 compresses and expands and can accordingly releaseably snap-fit into a protective cover or traveling case as illustrated below. Aerator 810 likewise includes a shortened tube 812 sized for single glass aeration. Shortened tube 812 can be made of any of the materials and alternatives discussed above for tubes 12 and 212, can be telescoping like tube 212, and can be about four inches (ten centimeters) or other suitable single glass distance long. Tube 812 can have any of the English or metric diameters and thread sizes discussed above for tubes 12 and 212. Shortened tube 812 is connected to a porous or sintered metal diffuser 820, which can be of any of the varieties and have any of the alternatives discussed repeatedly herein, and be removeably connected to tube 812 via any of the structures and methods discussed in connection with FIGS. 1, 7, 8A, 8B, 14 and 15. Diffuser 820 is alternatively permanently fixed, e.g., welded or heat sealed, to tube 812.

Squeezable portion 832 of standalone bulb pump 830 is in one embodiment substantially spherical at least towards its upper attachment end 834. Bulb pump 830 is flattened on its air intake end 836, so that flattened bottom 836 can be placed on a table or countertop and support stem 812 and diffuser 820 vertically as illustrated. Bulb pump 830 can be made of any material discussed herein for the bulb pumps, e.g., latex, silicone (e.g., high grade silicone) or polyvinylchloride ("PVC"). Bulb pump 830 can be flocked or left plain, e.g., for high grade silicone, and have any logo, information or indicia printed or silkscreened thereon. Air intake end 836 includes an imbedded one-way check valve, as has been described herein, for forcing air to exit diffuser 820.

In the illustrated embodiment, aerator 810 includes a drip cup 840. In one embodiment, drip cup 840 is formed with or molded into bulb pump 830. Drip cup 840 serves the same purpose as tub or basin top 538 of aerator 510, namely, to catch wine or spirit drips between uses. FIG. 19B illustrates that drip cup 840 can alternatively be formed with or attached to tube 812. In the illustrated embodiment, drip cup 840 is made of the same material as tube or stem 812. If tube or stem 812 is plastic, drip cup 840 can be molded with the plastic tube. If tube or stem 812 is metal, drip cup 840 can be made of the same metal, e.g., stainless steel, and be welded to stem 812 at the weld points illustrated in FIG. 19B.

FIG. 19B also illustrates that a locking ferrule 814 is formed with (e.g., plastic) stem 812 or welded to (e.g., metal) stem 812 at the weld points illustrated. Locking ferrule 814 is barbed to dig into upper attachment end 834 of squeezable portion 832 of bulb pump 830. A neck 838 of upper attachment end 834 is sized to compress slightly between drip cup 840 and locking ferrule 814 when stem 812 and ferrule 814 are inserted into neck 838 for locking engagement with bulb pump 830. In this manner, stem 812 and diffuser 820 are held firmly in place with the bulb pump. Alternatively, the lower or proximal end of tube 812 is connected removeably to bulb pump 830 using a threaded insert, for example, in the manner discussed above with aerator 510.

Figure 19D:
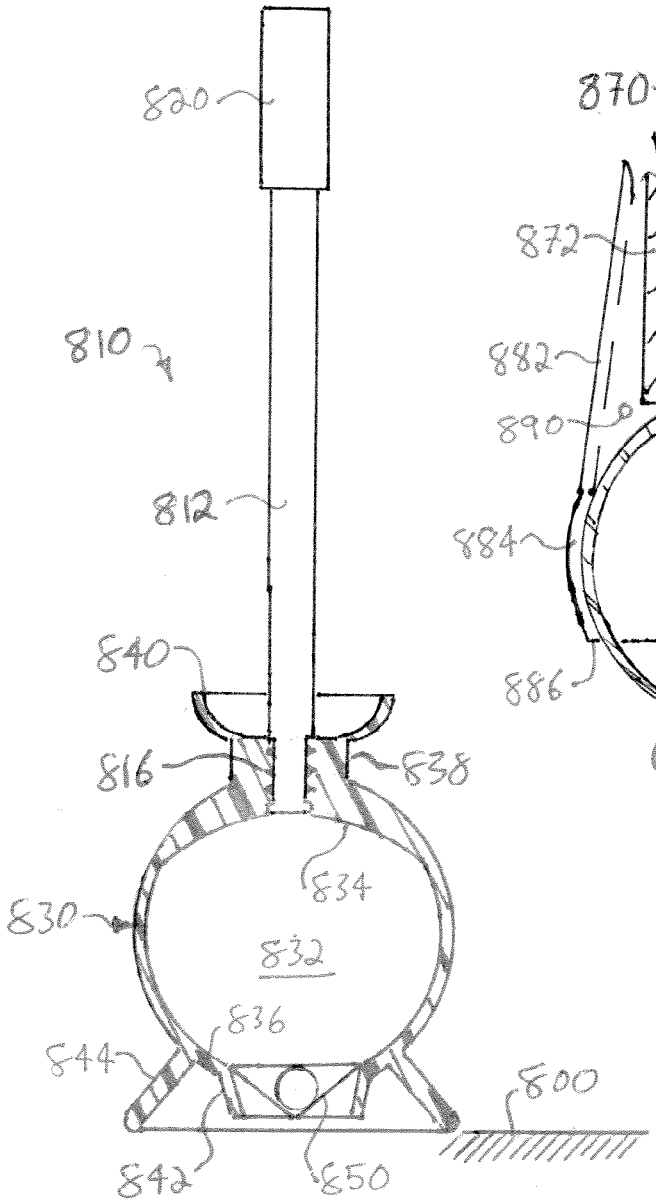
FIG. 19D is a partially sectioned elevation view of a yet another embodiment of a standalone, glass-by-glass wine or spirits aerator of the present disclosure.
Figure 19C:
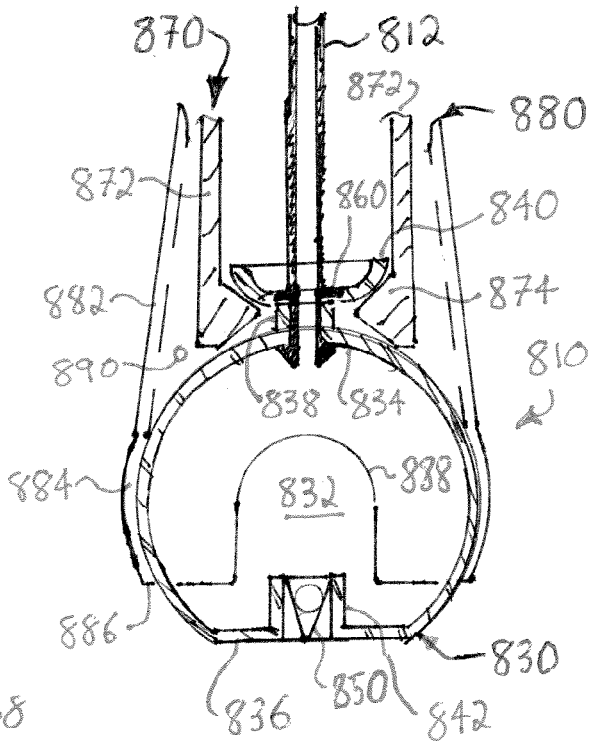
FIG. 19C is a partially sectioned elevation view yet another embodiment of a standalone, glass-by-glass wine or spirits aerator of the present disclosure in combination with alternative protective covers.

FIG. 19C illustrates one embodiment for providing flat air intake end 836. Flat intake end 836 includes or forms an inner collar 842 into which one-way valve 850 is inserted. One-way valve 850 can be press-fit, e.g., with barbs, preventing valve 850 from loosening outwardly when squeezable portion is placed under positive pressure, and/or be adhered to inner collar 842. Aerator 810 rests on flat portion 836, hiding valve until the aerator is lifted from the table or countertop.

An insert 860, e.g., stainless steel 316, is pressed through neck 838 from the outside, so that an upper flange and lower barb of the inserted compress neck 838 slightly, forming a sturdy, non-removable, fit. Stem 812 can be welded to the flange of insert 860, as illustrated, or be connected threadingly to the insert. Insert 560 of aerator 510 (and the inserts of aerators 610 and 710) can likewise be welded to the respective stem 512.

FIG. 19B also shows two different alternative protective covers 870 and 880 for any of the versions of aerator 810 discussed herein. Both protective covers 870 and 880 extend over and cover the entire length of tube 812 and diffuser 820 but are illustrated as sectioned in FIG. 19C for convenience. Protective covers 870 and 880 can be metal, plastic, wood, rubber and combinations thereof, and be formed as a single unitary piece or as a combination of multiple pieces.

Inner cover 870 includes sidewalls 872 extending downwardly along stem 812 and then transitioning to an inwardly extending, annular, beveled or triangular, flange 874. Beveled or triangular inward flange 874 is pushed onto aerator 810 and snaps over drip cup 840, which in this instance is rubber, and is held in place between drip cup 840 and upper attachment end 834 of squeezable portion 832 until the user wishes to remove cover 870. When the user wishes to remove cover 870, the user pulls cover 870 off of aerator 810, causing the upper beveled or angled edge of flange 874 to deform and compress drip cup 840, so that inward flange 874 and cover 870 can slide past drip cup 840, coming free from aerator 810.

Outer protective cover 880 includes sidewall(s) 882 extending downwardly along stem 812 and then transitioning to an outwardly bulging, annular ring 884. Annular ring 884 presses over the largest outside diameter of squeezable portion 832 in the illustrated embodiment. To don protective cover 880, the user presses squeezable portion 832 into annular ring 884. Notches 888 are provided 180 degrees apart in annular ring 884 to help the user guide squeezable portion 832 fully into annular ring 884. Squeezable portion 832 is deformed and compressed by the bottom edge 886 of ring 884 as portion 832 is slid up along the bottom edge. One or more air intake/release hole 890 can be provided in sidewall(s) 882 so that air displaced by and pumped from squeezable portion 832 can escape from cover 880. Eventually, squeezable portion 832 settles into place within annular ring 884, enabling portion 832 to expand to its natural volume, locking aerator 810 in place within protective cover 880.

Although not illustrated, it is contemplated to provide a sliding collar around annular ring 884, which the user can slide along ring 884 into a snap-lock position to cover notches 888 when it is desired to lock aerator within cover 880, and which the user can slide along ring 884 free from the snap-lock position, in the opposite direction, to expose notches 888 for removing aerator 810 from cover 880. The sliding collar can be in a tongue-and-groove, slideably connected relationship with annular ring 884, for example.

When the user wishes to remove cover 870, the user uses notches 888 to grasp the largest diameter of squeezable portion 832 and pull aerator 810 from the cover. Bottom edge 886 of ring 884 again deforms and compresses squeezable portion 832 on its way out of cover 870. Air squeezed from squeezable portion 832 though diffuser 820 into cover 880 should quell any vacuum tending to be caused by the withdrawal of aerator 810 from cover 880. In any case, one or more air intake/release hole 890 allows the pressure inside cover 880 to always be atmospheric. Aerator 810 is then pulled completely free from cover 880 for use.

Referring now to FIG. 19D, another implementation of substantially spherical aerator 810 is illustrated. Here, flat surface 836 of FIGS. 19A and 19C is replaced by a spherical bottom 836 that transitions to a collar 842, which extends outwardly from squeezable portion 832, and which may be easier to mold than the inwardly extending collar illustrated in FIG. 19C. Collar 842 holds one-way valve 850, which in the illustrated is a flatter, larger diameter valve. Such flatter one-way valves are commercially available. Here, the flattened valve serves additionally to support the upright positioning of the FIG. 19D implementation of aerator 810 onto a tabletop or counter 800. One-way valve 850 can be press-fit, held by barbs and/or adhered into collar 842.

The primary support mechanism for obtaining the upright positioning of the FIG. 19D implementation of aerator 810 onto a tabletop or counter 800 is a cylindrical stand 844, which is formed with bulb pump 830 of FIG. 19B. Cylindrical stand 844 can be solid as illustrated, or hollow to receive air as discussed above with legs 738 of bulb pump 730. Cylindrical stand 844 forms a circular interface with a structure 800, such as a table, countertop, bar or the like. Cylindrical stand 844 can be angled as illustrated with respect to structure 800 to form a conical stand. In the illustrated embodiment, the cylindrical wall of stand 844 is angled at about 45 degrees so that the cone if continued would come to a point at the center of spherical squeezable portion 832. Cylindrical wall of stand 844 can be at other angles relative to structure 800, including being 90 degrees relative to structure 800. Cylindrical wall can be of a uniform thickness as illustrated or of a thickness that varies, e.g., widens as it extends up to squeezable portion 832 of bulb 830. In the illustrated embodiment, stand 844 extends slightly below collar 842 and one-way valve 850 when set upon structure 800. Alternatively, stand 844 and collar 842 extend so as to be flush with each other when set upon structure 800.

Upper attachment end 834 of squeezable portion 832 of bulb pump 830 of FIG. 19B is thickened as illustrated for a number of reasons. First, thickened upper attachment end 834 provides length in addition to that of neck 838 for receiving, sturdily holding and sealing to the proximal end of tube 812. Extending the tube receiving length into squeezable portion 832 allows neck 838 to be shorter and tube 812 to be closer to structure 800, providing a squatter and more secure upright aerator, while still allowing for a sufficient aeration insertion length.

Second, thickened upper attachment end 834 creates a smooth, unobstructed passageway to the proximal end of tube 812, which allows any liquid entering squeezable portion 832 to be easily and fully squeezed out of the bulb pump. It is contemplated for single glass aerators to permanently attach tube 812 to bulb pump 830, and allowing diffuser 820 to be removed from stem 812 to thoroughly clean the stem/pump and the diffuser. Cleaning the stem/pump will involve sucking water into squeezable portion 832, which will need to be easily and completely discarded. Creating a step jump between the inner wall of squeezable portion 832 and the portion of the interior pump 830 holding the proximal end of stem 812 can create liquid holding pockets that may be difficult to drain. Thickened upper attachment and 834 eliminates such pockets.

Third, thickened upper attachment end 834 creates a more rigid squeezable portion 832, which helps bulb pump 830 to snap back into shape more quickly. Mechanically aiding bulb pump 830 in this way allows more flexible materials, such as silicone, to be used.

As discussed above, thickened upper attachment end 834 and neck 838 combine to provide an extended distance for firmly receiving, holding and sealing to the proximal end of tune 812. In the illustrated embodiment, the proximal end of tube 812 is notched and provided with a plurality of barbs 816, which in one embodiment are structured to prevent the movement of stem 812 in either direction relative to bulb pump 830 once fully inserted into the pump. The length of the notch in the proximal end of stem 812 is sized to compress fit over the combined length of thickened upper attachment end 834 and neck 838. The inner diameter of the insertion hole of bulb pump 830 is made smaller than the outer diameter of the notched portion of stem 812, causing bulb pump 830 to compress about barbs 816. In an alternative embodiment, the inner diameter of the insertion hole of bulb pump 830 is molded to have female threads for receiving mating alternative male threads formed onto the proximal end of stem 812.

Drip cup 840 is formed with bulb pump 830 in the illustrated embodiment. Bulb pump 830, stem 812 and diffuser 820 of FIG. 19D can be made of any of the respective materials discussed herein for the various pumps, stems and diffusers discussed above. Bulb pump 830, stem 812 and diffuser 820 of FIG. 19D can have any of the structural alternatives discussed herein for the various pumps, stems and diffusers discussed above. For example, any of the bulb/stem insertion structures of FIG. 16A, 16B, 19B or 19C could be used with aerator 810 of FIG. 19D.

Between uses of any of the full bottle or single glass aerators, it is contemplated to operate such aerators in a glass of cleaning liquid, such as water or carbonated water. Doing so cleans the previous liquid (wine or spirit) from the diffuser for use with a different wine or spirit. A few pump strokes performed while the diffuser is inserted in the cleaning liquid, followed by a few pump strokes while the diffuser is held in the air above the cleaning liquid should reset the aerator for next use.

Business Method

As discussed above, the aerators or breathing apparatuses of the present disclosure can aerate any tannin containing liquid, such as wine and various spirits, such as bourbon, brandy, cognac, gin, liqueur, rum, scotch, tequila and whiskey. It is also expressly contemplated to use any of the aerators of the present disclosure to promote the sale of such wines and spirits. For example, wine or spirits may be sold on a website. Each aerator sold includes literature, on itself or its packaging, directing the buyer to the website or marketplace for replacement and product information and also to view wines and/or being aerated using the aerators of the present disclosure. The website or marketplace accordingly hosts videos of different wines or spirits being aerated by any of the aerators of the present disclosure. Features and aspects of each of the wines or spirits are discussed in the context of how the aerator brings out and enhances the flavor of the wines or spirits. The video is accompanied by a shopping cart or similar product collection mechanism on the website or marketplace that allows each of the wines or spirits, discussed and analyzed after being aerated by one of the aerators of the present disclosure, to be selected for purchase. The sale of wine or spirits may be accompanied with the sale of one of the aerators discussed herein.

Carbonated Liquid Preparation Apparatus

Figures 20A, 20B, 20C, 20D:
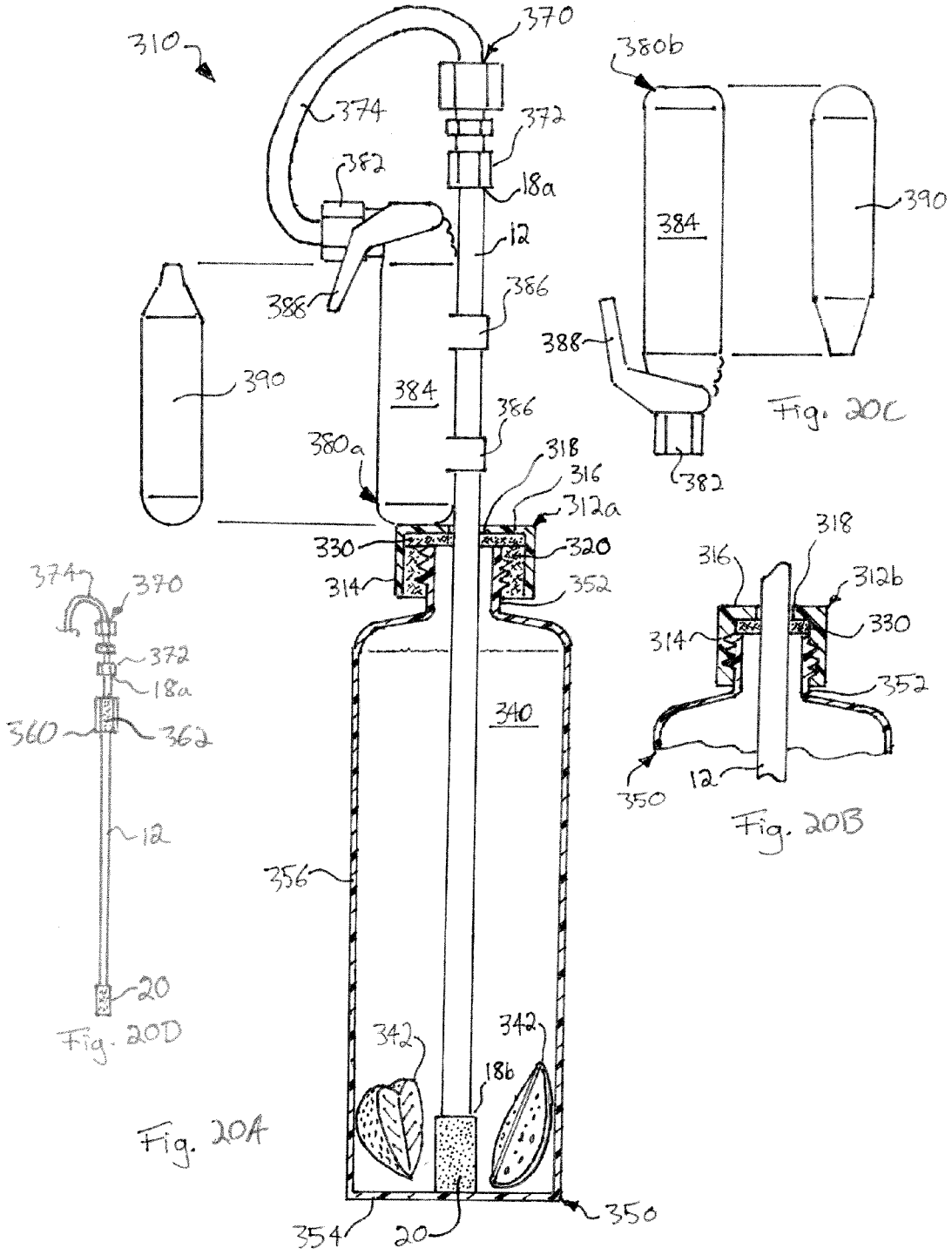
FIG. 20A is a partially sectioned elevation view of one embodiment of a carbonated liquid preparation apparatus of the present disclosure.
FIG. 20B is a partially sectioned elevation view of an alternative bottle cap arrangement for a carbonated liquid preparation apparatus of the present disclosure.
FIG. 20C is an elevation view of an alternative carbon dioxide injector for a carbonated liquid preparation apparatus of the present disclosure.
FIG. 20D is an elevation view of another alternative carbonated liquid preparation apparatus of the present disclosure.

Referring now to FIG. 20A, one embodiment of a carbonated beverage preparation apparatus of the present disclosure is illustrated by apparatus 310. Apparatus 310 includes tube 12, described above, having a proximal end 18*a* and distal end 18*b* as discussed above. Tube 12 can be made according to any embodiment discussed above and be, e.g., a type 304 or 316 stainless steel tube having an outer diameter of 0.250 inch (6.4 mm) or be of a like metric size, such as a six mm outer diameter tube. Tube 12 can be made alternatively of a food-safe plastic. Like with FIG. 7, in one embodiment, proximal end 18*a* and distal end 18*b* are threaded. For example, the threads can be ¼-20 straight threads. Finer threads, such as ¼-28 or ¼-32 straight threads or the metric equivalent, may be used alternatively. If a metric tube is provided, the threads are of a corresponding metric size and pitch. The threads of proximal end 18*a* and distal end 18*b* can alternatively be pipe threads, such as ⅛ or ¼ National Pipe Thread ("NPT") or corresponding British Standard Pipe Thread ("BSPT"). Proximal end 18*a* is further alternatively not threaded, is left instead as a tube end, and is connected instead to a tube compression fitting.

Tube or pipe 12 is of a suitable thickness to receive whichever threads are used. For example, the 0.250 inch (6.4 mm) outer diameter tube can have an 0.065 inch (1.7 mm) thick wall, leaving a 0.120 inch (3.0 mm) hole through which pressurized carbon dioxide travels. Tube 12 can be of any length discussed previously, or be shorter, e.g., on the order of eight to ten inches (20.3 to 25.4 cm). Tube 12 can have a diameter larger or smaller than 0.250 inch (6.4 mm) outer diameter as desired.

As before, threaded distal end 18*b* in one embodiment receives a diffuser 20, which can likewise be made of type 304 or 316 stainless steel. Diffuser 20 can be a porous cup or porous capped tube segment, formed via any known method, such as via a sintered or powdered metal process. Diffuser 20 is alternatively a porous plastic as has been described herein. The pore size of diffuser 20 can, for example, be less than one-hundred microns, such as ten microns, five microns, two microns, one micron or less than one micron, such as a half-micron or a fraction of a micron. Smaller pore sizes make smaller carbon dioxide ("$CO_2$") bubbles, which helps the $CO_2$ to diffuse into whatever liquid is being carbonated. While diffuser 20 is illustrated as being female threaded in FIG. 20A, diffuser is alternatively male threaded, as illustrated by diffusers 20*a* and 20*b* in FIGS. 8A and 8B.

As illustrated in FIG. 20A, tube 12 accepts a cap 312*a*. Cap 312*a* in the illustrated embodiment includes a cylindrical sidewall 314 extending from a top wall 316. Sidewall 314 and top wall 316 can be made of plastic or metal, such as type 304 or 316 stainless steel. Top wall 316 defines a hole 318 that is slightly larger than the outer diameter of tube 12. For example, if tube 12 is 0.250 inch (6.4 mm) outer diameter, hole 318 can be 0.313 inch (8.0 mm) in diameter. Sidewall 314 can be on the order of one-half inch (1.27 cm) or an inch (2.54 cm) long (vertical length). Top wall 316 can be on the order of one inch (2.54 cm) or larger depending upon whether cap 312*a* is threaded onto the top 352 of bottle 350 or is instead compressed translatingly onto top 352.

If cap 316 is threaded onto the top 352 of bottle 350, then cap 312*a* (including sidewall 314 and top wall 316) and bottle top 352 are sized and threaded according to any known size (e.g., about one inch (2.54 cm)) and thread used for soda bottles, bottled water, tonic water, soda water, energy drinks, sports drinks, and the like. Sidewall 314 of cap 312*a* includes female threads, while bottle top 352 includes mating male threads.

If cap 312*a* is instead compressed onto bottle top 352, then top wall 316 of cap 312*a* is radially large enough, e.g., 1.25 inches (3.18 cm), to hold a cylindrical gasket 320 along the inside surface of cylindrical sidewall 314, which becomes compressed to the outer surface of bottle top 352 when cap 312*a* is applied to bottle top 352. Gasket 320 can for example be silicone rubber or silicone sponge rubber, or other rubber or plastic material, and be of a thickness, e.g., 0.125 inch (3.2 mm), which allows cap 312*a* to be readily applied to and removed from bottle top 352, and which also provides a strong enough seal between cap 312*a* and bottle top 352, such that $CO_2$ (i) will not leak out between cap 312*a* and bottle top 352 and (ii) will not blow cap 312*a* off of bottle top 352 when $CO_2$ is pressurized within bottle 350. Gasket 320 is also of a suitable thickness to allow for variability in bottle top 352 diameter, e.g., between different industry standards. Gasket 320 may be configured to (i) slide or translate onto and off of the male threads of bottle top 352 or instead (ii) thread or spiral onto and off of the male threads.

In one embodiment, regardless of whether gasket 320 is provided or not, cap 312*a* provides an upper circular gasket 330, which is placed on the underside of top wall 316 of cap 312*a*. Gasket 330 includes or defines a hole (sealed around tube 12 in FIG. 20A), which is concentric with hole 318 formed in top wall 316. The gasket hole is in one embodiment of a slightly smaller diameter than the outer diameter of tube 12. For example, if tube 12 is 0.250 inch (6.4 mm) outer diameter, the gasket hole can be 0.188 inch (4.8 mm) in diameter. Gasket 330 can for example be silicone rubber or silicone sponge rubber, or other rubber or plastic material, and be of a thickness, e.g., 0.063 inch (1.6 mm) or 0.125 inch (3.2 mm), which allows cap 312*a* to be readily applied to and removed from (e.g., slid onto and off of) both tube 12 and bottle top 352. Gasket 330 is intended to seal cap 312*a* to tube 12 to prevent $CO_2$ from leaking out between cap 312*a* and tube 12 when $CO_2$ is pressurized within bottle 350. In one embodiment, gasket 330 is formed as a single integrated gasket with gasket 320.

When it is desired to use tube 12 and diffuser 20 for carbonation apparatus 310 instead of one of the aerators 10, 110 or 210, bulb pump 30 is removed from tube 12 and cap 312*a* is slid over the outside of tube 12 so that, as illustrated, the open cupped end of cap 312*a* faces bottle top 352. Bottle 350 in one embodiment is plastic or metal that is suitable for holding a liquid, such as water. Bottle 350 includes a circular base 354 and cylindrical sidewall 356 that are sized to hold a standard amount of a beverage, such as one-half liter, or smaller, to one liter, or two liters, or larger. Bottle 350 can be disposable but in one preferred ergonomically conscious embodiment is reusable, e.g., a safe reusable plastic or metal, such as aluminum, stainless steel and alloys thereof. In place of bulb pump 30, a $CO_2$ injector assembly 370 is connected to proximal end 18*a* of tube 12.

$CO_2$ injector assembly 370 in the illustrated embodiment includes a $CO_2$ injector 380*a*. The outlet fitting 382 of $CO_2$ injector 380*a* determines the type of fitting 372 that is needed for connection to proximal end 18*a* of tube 12. In the illustrated embodiment, outlet fitting 382 of $CO_2$ injector 380*a* is a tube compression fitting. Fitting 372 accordingly includes a female threaded end for connection to the male threaded proximal end 18*a* of tube 12 and a tube compression fitting for connecting sealingly to a flexible, e.g., plastic tube 374, which in turn runs to tube compression fitting outlet fitting 382 of $CO_2$ injector 380*a*. Flexible plastic tube 374 can be a 0.250 inch (about 6 millimeter ("mm")) outside diameter tube and be made for example of polyvinyl chloride ("PVC"). If outlet fitting 382 of $CO_2$ injector 380*a* is instead a female threaded fitting matching the male thread of proximal end 18*a* of tube 12, the $CO_2$ injector can then alternatively be connected directly to tube 12 as discussed in connection with FIG. 20C.

$CO_2$ injector 380*a* is known in other arts for such uses as aiding the growth of live plants in aquariums, the home brewing of beer, and bicycle tire inflation, for example. $CO_2$ injector 380*a* includes a cylindrical body 384 that receives a pressurized $CO_2$ cartridge 390. Cartridges 390 are provided standard in twelve and sixteen gram packages and may hold up to 125 psig of pressure. The present disclosure contemplates the use of larger cartridges 390 that may hold more or less pressure. In the illustrated embodiment, cylindrical body 384 includes clips 386 that allow $CO_2$ injector 380*a* to be releaseably snap-fitted to tube 12, e.g., resting on or near top wall 316 of cap 312*a*.

$CO_2$ injector 380*a* includes a spring-loaded handle 388 that the user pulls towards body 384 to release $CO_2$ gas through tube 374, fitting 372, tube 12, and diffuser 20 into liquid 340. It is contemplated that handle 388 need only be actuated for a few seconds to release enough $CO_2$ gas into bottle 350 to adequately carbonate liquid 340, e.g., water. Once handle 388 is released, its spring pushes handle 388 closed, stopping the flow of $CO_2$ gas ($CO_2$ cartridge 390 likely also includes a spring-loaded valve that is also biased to be normally closed upon the user's release of handle 388). Diffuser 20 provides the same advantages to the dispersion of both air and $CO_2$ gas, namely, forcing the air or $CO_2$ gas through tiny pores, e.g., less than one-hundred microns, such as ten microns, five microns, two microns, one micron or less than one micron, such as a half-micron or a fraction of a micron. The tiny holes or pores break the air or $CO_2$ gas into tiny bubbles that exit diffuser 20 as a plume of air bubbles or $CO_2$ gas bubbles. The weight of the wine or in this case liquid 340, it is believed, breaks the tiny bubbles down into even smaller microbubbles, which are even more readily diffused into the wine or liquid 340.

Liquid 340 is in one embodiment purified water, such as carbon filtered water or reverse osmosis ("RO") water. Tap water or deionized water could also be used. Liquid 340 is alternatively a juice, such as orange juice, grapefruit juice, strawberry juice, grape juice, apple juice, pineapple juice, mango juice, lemon juice, lime juice, cherry juice, and the like, and combinations thereof including combinations thereof diluted with water, such as purified water. Liquid 340 can further include, in any combination with or alone from above, soda syrup or any type of liquor, such as vodka, gin, rum or tequila, and the like. Liquid 340 could be any type of liquid that has gone flat, such as a soft drink or beer that has gone flat. Salt, sugar, herbs and/or spices may also be added to liquid 340. It is believed that the injection of $CO_2$ gas into a drink helps to mix and homogenize different the constituents making up liquid 340, such as juice and water, juice and liquor, water and liquor, and water, juice and liquor.

FIG. 20A also illustrates that it is contemplated for the user to place fruit or fruit slices 342 into bottle 350. Fruit or fruit slice 342 can be any suitable type of fruit, such as an orange, strawberry, grape, banana, apple, grapefruit, cherry, lemon, lime, kiwi, pineapple, and the like. It is believed that the action of the air bubble plume emanating from diffuser 20 will help to disperse juice and flavor from fruit or fruit slices 342 into liquid 340, which can be any of the liquids or liquid combinations discussed above. Thus is it contemplated for a method of making an all natural carbonated drink to place purified water into a bottle or container along with desired fruit or fruit slices, and then to inject $CO_2$ gas into the bottle or container to carbonate the water and to disperse juice and flavor from the fruit into the water. Once the beverage is consumed, the fruit can be removed from the bottle, and the bottle can be rinsed or washed for reuse.

Bottle 350 can be plastic or metal as has been described above. It is contemplated to provide a reusable bottle 350 as part of carbonated beverage preparation apparatus 310. Along with bottle 350, it is contemplated to provide a separate cap (not illustrated), which threads or otherwise removeably attaches and seals to bottle top 352. The separate cap does not need any gasketing and can instead be a standard cap. The separate cap is used after carbonation, once tube 12 and diffuser 20 are removed from bottle 350. To do so, cap 312*a* if threaded to bottle top 352 is unthreaded from top 352. Or, if cap 312*a* is instead press-fitted onto bottle top 352, as discussed above, cap 312*a* can instead be pulled off of bottle top 352. Tube 12 and diffuser 20 are then removed from bottle 350, after which the separate cap is applied to seal the newly created carbonated beverage for transport.

Referring now to FIG. 20B, an alternative cap 312*b* applied to the top bottle top 352 of bottle 350 as illustrated. Here, cylindrical gasket 320 along the inside surface of cylindrical sidewall 314 is not used. Instead, cylindrical sidewall 314, which can be any metal or plastic described above for bottle 350 or cap 312*a*, threads directly onto and off of bottle top 352. Upper circular gasket 330 is still provided however and seals around the outside of tube 12. Apparatus 310 can be provided with multiple caps 312*b*, each having different thread sizes to fit onto different, e.g., standardized, threads of bottle top 352.

While bottle 350 is illustrated in FIGS. 20A and 20B as being capped and sealed, it is expressly contemplated that bottle 350 or any suitable glass or other container can instead be open, uncapped, and unsealed. It is believed that the use of diffuser 20 at the end of tube 12 will be effective to allow enough of the $CO_2$ gas plume emanating from tube 12 to diffuse into liquid 340 and form a carbonated beverage even if the container is uncapped. The $CO_2$ gas plume will also be smooth and steady enough to minimize or prevent $CO_2$ gas bubbles coming out of liquid 340 at rate that would cause splashing or cause liquid 340 to fly out of the glass or container. It is therefore expressly contemplated to carbonate any of the liquid combinations, including with or without fruit or fruit slices 342, or to carbonate purified water alone using an open, uncapped container.

Referring now to FIG. 20C, an alternative $CO_2$ injector 380*b* is illustrated. Alternative $CO_2$ injector 380*b* includes an outlet fitting 382 that threads directly onto and off of proximal end 18*a* of tube 12, eliminating tube 374. Outlet fitting 382 is alternatively a tube fitting that compression fits via a ferrule directly onto and off of proximal end 18*a* of tube 12, which here is not threaded and left instead as a tube end, again eliminating tube 374. Additionally, outlet fitting 382 is rotated ninety degrees from the orientation of $CO_2$ injector 380*a*, so as to form an inline injector as opposed to the right angle injector 380*b* of FIG. 9A. $CO_2$ injector 380*a* connected directly to tube 12 and having inline outlet fitting 382 forms a portable, handheld $CO_2$ wand that can be inserted into and removed from bottle 350 quickly and easily. In a further alternative embodiment, right angle outlet fitting 382 of FIG. 20A is a female thread or tube connector that threads or compression fits directly onto proximal end 18*a* of tube 12, forming a gun-like $CO_2$ injection apparatus. In any case, clips 386 of $CO_2$ injector 380*a* are not needed as the threaded connection between outlet fitting 382 and proximal end 18*a* of tube 12 holds $CO_2$ injector 380*b* and tube 12 with diffuser 20 structurally together. The operation of handle 388 and the displacement of $CO_2$ gas from $CO_2$ injector 380*b* through diffuser 20 is the same as described above for $CO_2$ injector 380*a*.

Carbonated beverage preparation apparatus 310 is in one embodiment provided as a standalone apparatus. That is, apparatus 310 does not have to be prepared by transitioning one of the aerators discussed above into the carbonated beverage preparation apparatus. It may be desirable for example to make tube 12 shorter in length for carbonated beverage preparation apparatus 310 than for the full bottle aerators discussed above.

Referring now to FIG. 20D, an alternative tube 12 can be used with any of the embodiments discussed in connection with FIGS. 20A to 20C. To provide environment for alternative tube 12, tube 374 and fitting 372 of $CO_2$ injector assembly 370, tube 12, and diffuser 20 of FIG. 20A are illustrated. In FIG. 20D, however, a housing 360 is welded or fitted, e.g., press-fitted or threaded, into tube 12. Housing 360 is made of the same material as tube 12 in one embodiment, e.g., stainless steel. Housing 360 holds a pressure and/or flow dropping medium 362, which drops the pressure and/or flow of $CO_2$ exiting cartridge 390 significantly below reaching diffuser 20. Pressure and/or flow dropping medium 362 can be any known pressure or flow regulator. Pressure dropping medium 362 can alternatively be a specifically sized and structured material discussed above for diffuser 20, such as a polymer material, wood, cork, rubber, metal or combinations thereof. The pore size of the material for pressure and/or flow dropping medium 362 can, for example, be less than one-hundred microns, such as ten microns, five microns, two microns, one micron or less than one micron, such as a half-micron or fraction of a micron.

Besides carbonated beverage preparation, it is contemplated to use the embodiments set forth in FIGS. 20A to 20D for the feeding of plants, such as cut flowers in water and aquatic plants. Diffusing $CO_2$ into water used for cut flowers and for aquatic plant water can enhance and prolong the life of the plants.

Additional Aspects of the Present Disclosure

In light of the above description and drawings, and without limiting the invention in any way, in a first aspect, the present disclosure includes a wine and spirit aeration apparatus including a tube; a diffuser attached to a distal end of the tube; and an air pump attached to a proximal end of the tube, the air pump operable to pump air through the tube and diffuser, into a wine or spirit, the proximal end of the tube left unobstructed so that when the apparatus is used to aerate a whole bottle of the wine or spirit, the air can flow from the wine or spirit, out of the bottle.

In a second aspect, which may be used in combination with any other aspect listed herein, the air pump is a manual bulb pump.

In a third aspect, which may be used in combination with any other aspect listed herein, the air pump is attached to the proximal end of the tube (i) via an insert placed into the air pump, (ii) directly to the proximal end of the tube, or (iii) via a piercing member that pierces a plug inserted into the proximal end of the tube.

In a fourth aspect, which may be used with the third aspect in combination with any other aspect listed herein, the insert threadingly engages the proximal end of the tube.

In a fifth aspect, which may be used with the third aspect in combination with any other aspect listed herein, the insert holds a gasket for sealing to the proximal end of the tube.

In a sixth aspect, which may be used in combination with any other aspect listed herein, the diffuser includes sintered metal.

In a seventh aspect, which may be used in combination with any other aspect listed herein, the diffuser includes openings less than one-hundred microns in average diameter.

In an eighth aspect, which may be used in combination with any other aspect listed herein, the diffuser has a tubular shape.

In a ninth aspect, which may be used in combination with any other aspect listed herein, the diffuser is releaseably attached to the distal end of the tube, so that the tube and/or diffuser can be separated and cleaned.

In a tenth aspect, which may be used with the ninth aspect in combination with and any other aspect listed herein, the diffuser is releaseably press-fitted to the distal end of the tube via a gasket.

In an eleventh aspect, which may be used with the ninth aspect in combination with and any other aspect listed herein, the diffuser is releaseably threaded to the distal end of the tube.

In a twelfth aspect, which may be used in combination with any other aspect listed herein, the distal end of the tube and the diffuser are located a distance away from the air pump, such that when inserted into the wine or spirit bottle, air leaving the diffuser effectively travels the entire length of the bottle.

In a thirteenth aspect, which may be used in combination with any other aspect listed herein, the tube includes at least one of (i) a first tube segment and a second tube segment connected telescopically to the first tube segment, or (ii) a kickstand for suspending the diffuser off of a table or other structure when the aeration apparatus is set down between uses.

In a fourteenth aspect, which may be used in combination with any other aspect listed herein, the air pump is removable from the proximal end of the tube, and which includes a carbon dioxide ("$CO_2$") injector attachable directly or indirectly to the proximal end of the tube, such that the apparatus becomes a carbonated beverage preparation apparatus or a plant feeding apparatus.

In a fifteenth aspect, which may be used in combination with any other aspect listed herein, a wine and spirit aeration apparatus includes a tube; a diffuser attached to a distal end of the tube; and a manual air pump attached to a proximal end of the tube and operable to pump air through the tube and diffuser into a wine or spirit, the manual air pump shaped to be set on a structure between uses and support the tube and diffuser above the manual air pump.

In a sixteenth aspect, which may be used with the fifteenth aspect in combination with any other aspect listed herein, the tube is sized for single glass aeration.

In a seventeenth aspect, which may be used with the fifteenth aspect in combination with any other aspect listed herein, the manual air pump is shaped to include a plurality of legs for setting the apparatus on the structure and supporting the tube and diffuser above the manual air pump.

In an eighteenth aspect, which may be used with the fifteenth aspect in combination with any other aspect listed herein, the manual air pump is shaped to have a flattened side and an imbedded one-way valve for setting the apparatus on the structure and supporting the tube and diffuser above the manual air pump.

In a nineteenth aspect, which may be used with the fifteenth aspect in combination with any other aspect listed herein, the wine and spirit aeration apparatus includes a stand extending from the manual air pump for setting the apparatus on the structure and supporting the tube and diffuser above the manual air pump.

In a twentieth aspect, which may be used with the nineteenth aspect in combination with any other aspect listed herein, the stand is any one or more of: conical, solid, open to receive air, or a shape forming a circular interface with the structure.

In a twenty-first aspect, which may be used with the fifteenth aspect in combination with any other aspect listed herein, the manual air pump is shaped to have bellows type legs for setting the apparatus on the structure and supporting the tube and diffuser above the manual air pump.

In a twenty-second aspect, which may be used with the fifteenth aspect in combination with any other aspect listed herein, one of the tube or the manual air pump is formed or provided with a drip cup for catching drips when the apparatus is set on the structure and supporting the tube and diffuser above the manual air pump.

In a twenty-third aspect, which may be used with the twenty-second aspect in combination with any other aspect listed herein, the drip cup is molded as part of the manual air pump.

In a twenty-fourth aspect, which may be used with the fifteenth aspect in combination with any other aspect listed herein, the wine and spirit aeration apparatus includes a flattened one-way valve that sits on the structure to help support the tube and diffuser above the manual air pump.

In a twenty-fifth aspect, which may be used with the fifteenth aspect in combination with any other aspect listed herein, at least one of the diffuser or the manual air pump is removeably attached to the tube.

In a twenty-sixth aspect, which may be used with the fifteenth aspect in combination with any other aspect listed herein, the wine and spirit aeration apparatus includes a protective case, the tube and a diffuser extending into the case, the manual air pump releaseably snapping into the case.

In a twenty-seventh aspect, which may be used in combination with any other aspect listed herein, a wine and spirit aeration method includes structuring an aerator so that it can be used to aerate a spirit, operated in a cleaning liquid to remove residual spirit from the aerator, and then used to aerate wine and vice-versa.

In a twenty-eighth aspect, which may be used with the twenty-seventh aspect in combination with any other aspect listed herein, the cleaning liquid is water or carbonated water.

In a twenty-ninth aspect, which may be used in combination with any other aspect listed herein, the wine or spirit aeration apparatus includes a stopper fitted to the tube, the stopper sized and shaped to be sealably and releaseably inserted into a lip of a wine bottle. The stopper can (i) have a conical shape and is made of cork, rubber or plastic, (ii) be permanently fixed to the tube, (iii) be moveably fixed to the tube, (iv) be moveable along the tube between a full bottle diffusion position, a half bottle diffusion position and a single glass diffusion position, (vi) be moveable along the tube between positions designated by markers, (vi) be moveable along the tube between positions designated by at least one stopper holding member, and wherein the stopper holding member can include a circular rib protruding about the tube, or (vii) include a generally cylindrical wall angled inwardly from top to bottom relative to the wine bottle at ten to thirty-five degrees.

In a thirtieth aspect, which may be used in combination with any other aspect listed herein, the aeration tube is bendable but generally holds its shape.

In a thirty-first aspect, which may be used in combination with any other aspect listed herein, the diffuser is made of a porous plastic, and wherein the porous plastic diffuser can thread into a distal end of the tube.

In a thirty-second aspect, which may be used in combination with any other aspect or combination of aspects listed herein, a wine and spirit aeration apparatus includes: a first tube segment; a second tube segment connected telescopically to the first tube segment; an air pump placed in fluid communication with the first tube segment; and a diffuser attached to the second tube segment.

In a thirty-third aspect, which may be used in combination with the thirty-second aspect and any other aspect or combination of aspects listed herein, the air pump is connected to the proximal end of the tube.

In a thirty-fourth aspect, which may be used in combination with the thirty-second aspect and any other aspect or combination of aspects listed herein, the wine and spirit aeration apparatus includes a first collar placed on an inside of a larger diameter one of the first and second tube segments, and a second collar placed on an outside of the smaller diameter other of the first and second tube segments, the collars abutting when the wine and spirit aeration apparatus is in its most contracted condition.

In a thirty-fifth aspect, which may be used in combination with the thirty-second aspect and any other aspect or combination of aspects listed herein, the first and second collars are of a same inner and outer diameter.

In a thirty-sixth aspect, which may be used in combination with the thirty-second aspect and any other aspect or combination of aspects listed herein, a distal end of the second tube segment is thickened and threaded or includes a threaded insert for threadingly connecting to the diffuser.

In a thirty-seventh aspect, which may be used in combination with any other aspect or combination of aspects listed herein, a method for marketing wine or spirits includes: providing a wine or spirits aerator; creating a video in which the wine or spirits aerator is used to aerate a wine, wherein at least one feature or aspect of the wine or spirits is discussed in connection with the aeration of the wine or spirits; enabling the video to be viewed on a website; and offering the wine or spirits for sale via the website.

In a thirty-eighth aspect, which may be used in combination with the thirty-seventh aspect and any other aspect or combination of aspects listed herein, the method for marketing wine or spirits further includes offering the aerator for sale via the website.

In a thirty-ninth aspect, which may be used in combination with any other aspect or combination of aspects listed herein, a carbonated beverage preparation apparatus includes: a tube; a diffuser attached to a distal end of the tube; and a carbon dioxide ("$CO_2$") injector in fluid communication with a proximal end of the tube, the $CO_2$ injector operable to push $CO_2$ gas through the tube and diffuser into a liquid to carbonate the liquid. The tube can be provided with a housing holding a pressure and/or flow reducing medium for reducing the pressure and/or flow of $CO_2$ gas flowing to the diffuser.

In a fortieth aspect, which may be used in combination with the thirty-ninth aspect and any other aspect or combination of aspects listed herein, the tube is a first tube, and wherein the $CO_2$ injector is connected to the proximal end of the first tube via a second tube.

In a forty-first aspect, which may be used in combination with the thirty-ninth aspect and any other aspect or combination of aspects listed herein, the $CO_2$ injector is connected to and held by the tube.

In a forty-second aspect, which may be used in combination with the thirty-ninth aspect and any other aspect or combination of aspects listed herein, the $CO_2$ injector is connected directly to the proximal end of the tube.

In a forty-third aspect, which may be used in combination with the thirty-ninth aspect and any other aspect or combination of aspects listed herein, the carbonated beverage preparation apparatus includes a bottle for holding the liquid.

In a forty-fourth aspect, which may be used in combination with the thirty-ninth aspect and any other aspect or combination of aspects listed herein, the carbonated beverage apparatus includes a cap coupled slidingly to the tube, the cap configured to cap a bottle or container holding the liquid.

In a forty-fifth aspect, which may be used in combination with the thirty-ninth aspect and any other aspect or combination of aspects listed herein, the cap includes a gasket configured to seal to the bottle or container.

In a forty-sixth aspect, which may be used in combination with the forty-fifth aspect and any other aspect or combination of aspects listed herein, the cap includes a gasket configured to seal to the tube.

In a forty-seventh aspect, which may be used in combination with the forty-fifth aspect and any other aspect or combination of aspects listed herein, the cap is threaded for threaded connection and removal from the bottle or container.

In a forty-eighth aspect, which may be used in combination with the forty-fifth aspect and any other aspect or combination of aspects listed herein, the cap is configured and arranged to translate sealingly onto the bottle or container.

In a forty-ninth aspect, which may be used in combination with the any other aspect or combination of aspects listed herein, a hand or bulb air pump can include a threaded plug or insert for stiffening the pump and/or for sealing threads to the pump.

In additional aspects, any of the structure and functionality discussed in connection with FIGS. 1 to 20D may be used in combination with any other aspect or combination of aspects discussed herein.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A wine and spirit aeration apparatus comprising:

a tube;

a diffuser releaseably press-fitted to a distal end of the tube via a gasket; and an air pump attached to a proximal end of the tube, the air pump operable to pump air through the tube and diffuser, into a wine or spirit, the proximal end of the tube left unobstructed so that when the apparatus is used to aerate a whole bottle of the wine or spirit, the air can flow from the wine or spirit, out of the bottle.

2. The wine and spirit aeration apparatus of claim 1, wherein the air pump is a manual bulb pump.

3. The wine and spirit aeration apparatus of claim 1, wherein the air pump is attached to the proximal end of the tube via an insert placed into the air pump.

4. The wine and spirit aeration apparatus of claim 3, wherein the insert threadingly engages the proximal end of the tube.

5. The wine and spirit aeration apparatus of claim 3, wherein the insert holds a gasket for sealing to the proximal end of the tube.

6. The wine and spirit aeration apparatus of claim 1, wherein the diffuser includes sintered metal.

7. The wine and spirit aeration apparatus of claim 1, wherein the diffuser includes openings less than one-hundred microns in average diameter.

8. The wine and spirit aeration apparatus of claim 1, wherein the diffuser has a tubular shape.

9. The wine and spirit aeration apparatus of claim 1, wherein the diffuser is releaseably attached to the distal end of the tube, so that the tube and/or diffuser can be separated and cleaned.

10. The wine and spirit aeration apparatus of claim 1, wherein the gasket is fitted into a groove formed in the tube.

11. The wine and spirit aeration apparatus of claim 1, wherein the gasket is fitted into a groove formed in the diffuser.

12. The wine and spirit aeration apparatus of claim 1, wherein the distal end of the tube and the diffuser are located a distance away from the air pump, such that when inserted into the wine or spirit bottle, air leaving the diffuser effectively travels the entire length of the bottle.

13. The wine and spirit aeration apparatus of claim 1, wherein the tube includes a first tube segment and a second tube segment connected telescopically to the first tube segment.

14. The wine and spirit aeration apparatus of claim 1, wherein the air pump is removable from the proximal end of the tube, and which includes a carbon dioxide ("CO2") injector attachable directly or indirectly to the proximal end of the tube, such that the apparatus becomes a carbonated beverage preparation apparatus or a plant feeding apparatus.

15. A wine aeration apparatus comprising:

a tube;

a diffuser releaseably press-fitted to a distal end of the tube via a gasket; and an air pump attached to a proximal end of the tube, the air pump operable to pump air through the tube and diffuser, into a wine or spirit, the proximal end of the tube configured so that when the apparatus is used to aerate a whole bottle of the wine or spirit, the air can flow from the wine or spirit, out of the bottle.

16. The wine aeration apparatus of claim 15, wherein the gasket is fitted into a groove formed in the tube.

17. The wine aeration apparatus of claim 15, wherein the gasket is fitted into a groove formed in the diffuser.

18. The wine aeration apparatus of claim 15, wherein the gasket is a gasket sleeve.

19. The wine aeration apparatus of claim 15, wherein the gasket is an o-ring gasket.

* * * * *